US011052010B2

(12) United States Patent
Oshima et al.

(10) Patent No.: US 11,052,010 B2
(45) Date of Patent: Jul. 6, 2021

(54) TRAINING DEVICE AND METHOD FOR CORRECTING FORCE

(71) Applicants: Murata Machinery, Ltd., Kyoto (JP); Teijin Pharma Limited, Tokyo (JP)

(72) Inventors: Osamu Oshima, Kyoto (JP); Hiroaki Ohmatsu, Kyoto (JP); Fumi Fujita, Tokyo (JP); Akihiro Maeda, Tokyo (JP); Jun Takeda, Tokyo (JP)

(73) Assignees: Murata Machinery, Ltd., Kyoto (JP); Teijin Pharma Limited, Tokyo (JP)

( * ) Notice: Subject to any disclaimer, the term of this patent is extended or adjusted under 35 U.S.C. 154(b) by 765 days.

(21) Appl. No.: 15/521,885

(22) PCT Filed: Oct. 13, 2015

(86) PCT No.: PCT/JP2015/078919
§ 371 (c)(1),
(2) Date: Apr. 25, 2017

(87) PCT Pub. No.: WO2016/067910
PCT Pub. Date: May 6, 2016

(65) Prior Publication Data

US 2017/0333277 A1 Nov. 23, 2017

(30) Foreign Application Priority Data

Oct. 29, 2014 (JP) ..... JP2014-220071

(51) Int. Cl.
*A61H 1/02* (2006.01)
*A63B 21/00* (2006.01)
(Continued)

(52) U.S. Cl.
CPC ..... *A61H 1/02* (2013.01); *A61H 1/0237* (2013.01); *A61H 1/0274* (2013.01);
(Continued)

(58) Field of Classification Search
CPC ..... A61H 1/02; A61H 1/0237; A61H 1/0274; A61H 2201/1215; A61H 2201/1463;
(Continued)

(56) References Cited

U.S. PATENT DOCUMENTS 7,252,644 B2 * 8/2007 Dewaid ..... A61H 1/02 601/23
8,932,183 B2 1/2015 Ishii et al.
(Continued)

FOREIGN PATENT DOCUMENTS

EP 2 687 341 A2 1/2014
JP 2000-279463 A 10/2000
(Continued)

OTHER PUBLICATIONS

English language translation of International Search Report dated Jan. 19, 2016 issued in corresponding PCT application PCT/JP2015/078919.
(Continued)

*Primary Examiner* — Tu A Vo
*Assistant Examiner* — Alexander Morales
(74) *Attorney, Agent, or Firm* — DLA Piper LLP (US)

(57) ABSTRACT

A training device suppresses unintended operation of an operation rod when executing an operation mode in which operation of the operation rod is controlled based on a force applied to the operation rod. The training device includes the operation rod, a motor, a force detector, a rotation information output sensor, a first command calculator, and a force corrector. The operation rod moves a limb. The motor operates the operation rod in a direction of degree of freedom. The force detector detects a force component and outputs a force component signal. The rotation information output sensor detects an operation position of the operation rod in a corresponding direction of degree of freedom. The
(Continued)

force corrector calculates a corrected force component value based on operation positions of the operation rod and force component signal. The first command calculator calculates a first motor control command based on the corrected force component value.

6 Claims, 23 Drawing Sheets

(51) Int. Cl.

| | |
|---|---|
| ***A63B 21/005*** | (2006.01) |
| ***A63B 23/035*** | (2006.01) |
| ***A63B 21/02*** | (2006.01) |
| ***A63B 71/06*** | (2006.01) |
| ***A63B 22/00*** | (2006.01) |
| ***A63B 23/12*** | (2006.01) |

(52) U.S. Cl.
CPC .... *A63B 21/0058* (2013.01); *A63B 21/00178* (2013.01); *A63B 21/025* (2013.01); *A63B 21/4035* (2015.10); *A63B 21/4047* (2015.10); *A63B 23/03508* (2013.01); *A61H 2201/1215* (2013.01); *A61H 2201/1463* (2013.01); *A61H 2201/1633* (2013.01); *A61H 2201/1635* (2013.01); *A61H 2201/1638* (2013.01); *A61H 2201/1642* (2013.01); *A61H 2201/1673* (2013.01); *A61H 2201/1676* (2013.01); *A61H 2201/1685* (2013.01); *A61H 2201/5007* (2013.01); *A61H 2201/5035* (2013.01); *A61H 2201/5041* (2013.01); *A61H 2201/5043* (2013.01); *A61H 2201/5061* (2013.01); *A61H 2201/5064* (2013.01); *A61H 2201/5069* (2013.01); *A61H 2201/5092* (2013.01); *A61H 2201/5097* (2013.01); *A61H 2203/0431* (2013.01); *A63B 23/1209* (2013.01); *A63B 2022/0094* (2013.01); *A63B 2071/0658* (2013.01); *A63B 2071/0683* (2013.01); *A63B 2208/0233* (2013.01); *A63B 2220/20* (2013.01); *A63B 2220/51* (2013.01); *A63B 2220/805* (2013.01); *A63B 2225/20* (2013.01)

(58) Field of Classification Search
CPC .... A61H 2201/1633; A61H 2201/1635; A61H 2201/1638; A61H 2201/164; A61H 2201/1673; A61H 2201/1676; A61H 2201/1685; A61H 2201/5007; A61H 2201/5035; A61H 2201/5041; A61H 2201/5043; A61H 2201/5061; A61H 2201/5064; A61H 2201/5069; A61H 2201/5092; A61H 2201/5097; A61H 2203/0431; A61H 3/00; A63B 21/00178; A63B 21/0058; A63B 21/025; A63B 21/4035; A63B 21/4047; A63B 23/03508; A63B 23/1209; A63B 2022/0094; A63B 2071/0658; A63B 2071/0683; A63B 2208/0233; A63B 2220/20; A63B 2220/51; A63B 2220/805; A63B 2225/20; B25J 9/0006
See application file for complete search history.

(56) References Cited

U.S. PATENT DOCUMENTS

| | | | | |
|---|---|---|---|---|
| 8,958,914 | B2 * | 2/2015 | Inazumi | B25J 9/1612 700/245 |
| 9,492,925 | B2 * | 11/2016 | Aiso | B25J 9/1697 |
| 2004/0158175 | A1 * | 8/2004 | Ikeuchi | A61H 3/008 601/5 |
| 2006/0293617 | A1 * | 12/2006 | Einav | A61H 1/0274 601/33 |
| 2009/0227925 | A1 * | 9/2009 | McBean | A61F 5/0127 602/16 |
| 2010/0130893 | A1 * | 5/2010 | Sankai | A61B 5/224 601/5 |
| 2013/0281261 | A1 * | 10/2013 | Gatherer | A61G 7/1059 601/26 |
| 2014/0012164 | A1 * | 1/2014 | Tanaka | A61F 2/72 601/35 |
| 2015/0051519 | A1 * | 2/2015 | Morbi | A61G 7/1059 601/26 |
| 2015/0173993 | A1 * | 6/2015 | Walsh | A61F 2/68 414/4 |
| 2015/0190200 | A1 * | 7/2015 | Courtine | A61B 5/4519 604/20 |
| 2015/0196449 | A1 * | 7/2015 | Ahn | A61H 1/024 623/27 |

FOREIGN PATENT DOCUMENTS

| | | | |
|---|---|---|---|
| JP | 2007-37667 | A | 2/2007 |
| WO | 2005/074371 | A2 | 8/2005 |
| WO | 2012/117488 | A1 | 9/2012 |

OTHER PUBLICATIONS

Extended European Search Report dated Jun. 15, 2018, of counterpart European Patent Application No. 15854158.1.

* cited by examiner

| | | |
|---|---|---|
| Force #1 | Force component signal | $V_{x1}$ |
| | | $V_{y1}$ |
| | | $V_{L1}$ |
| | Force component | $F_{x1}$ |
| | | $F_{y1}$ |
| | | $F_{L1}$ |
| Force #2 | Force component signal | $V_{x2}$ |
| | | $V_{y2}$ |
| | | $V_{L2}$ |
| | Force component | $F_{x2}$ |
| | | $F_{y2}$ |
| | | $F_{L2}$ |
| ⋮ | | |
| Force #n | Force component signal | $V_{xn}$ |
| | | $V_{yn}$ |
| | | $V_{Ln}$ |
| | Force component | $F_{xn}$ |
| | | $F_{yn}$ |
| | | $F_{Ln}$ |

FIG. 12

| Length / Position | $L_1$ | $L_2$ | $L_3$ | | $L_m$ |
|---|---|---|---|---|---|
| $y_1$ | W11 | W21 | W31 | | Wm1 |
| $y_2$ | W12 | W22 | W32 | ..... | Wm2 |
| $y_3$ | W13 | W23 | W33 | | Wm3 |
| ⋮ | ⋮ | ⋮ | ⋮ | | ⋮ |
| $y_j$ | W1j | W2j | W3j | | Wmj |

FIG. 20

TRAINING DEVICE AND METHOD FOR CORRECTING FORCE

CROSS REFERENCE TO RELATED APPLICATIONS

This application is a national stage of international application No. PCT/JP2015/078919, filed on Oct. 13, 2015, and claims the benefit of priority under 35 USC 119 of Japanese application No. 2014-220071, filed on Oct. 29, 2014, both of which are incorporated herein by reference in their entirety.

TECHNICAL FIELD

The present invention relates to a training device, having an operation rod driven by a motor, for aiding rehabilitation of an upper limb and a lower limb of a patient according to a predetermined training program.

BACKGROUND ART

Rehabilitation aimed at motor function recovery of an upper limb or a lower limb of a stroke patient with hemiplegia is usually performed by an occupational therapist or a physical therapist, and hence there is a limitation in efficient offering of rehabilitation. For example, in rehabilitation aimed at motor function recovery of an upper limb, it is mainly required to repeat as much as possible an accurate movement of the paralyzed upper limb passively and actively in a movement range slightly larger than current range. On the basis of the rehabilitation for the motor function recovery, the occupational therapist or the physical therapist teaches the accurate movement to the patient and manually applies a load on the upper limb of the patient so as to induce an active movement.

In this rehabilitation, the number of repetition of the movement is limited due to exhaustion of the therapist or a time limit for providing the rehabilitation. In addition, it is possible that a difference in medical quality of the rehabilitation exists depending on experience of the therapist. Accordingly, in order to eliminate the limitations in providing the rehabilitation and equalize the medical quality as much as possible by supporting the training by the therapist, there is known an upper limb training device as described in Patent Citation 1, for example, which aids rehabilitation of a patient with a disabled limb such as an arm. This device includes a fixed frame that can be placed on a floor, a movable frame supported by the fixed frame so as to be capable of tilting in all directions, and an operation rod attached to the movable frame in an expandable/contractible manner so as to be operated manually by a person who undergoes the training.

PRIOR ART CITATIONS

Patent Citation

Patent Citation 1: PCT publication No. WO 2012/117488

SUMMARY OF INVENTION

Technical Problem

The training device as disclosed in Patent Citation 1 has an operation mode in which the operation of the operation rod is controlled based on a force applied to the operation rod by a limb of the patient supported by the operation rod.

In the training device of Patent Citation 1, the operation rod may perform an unintended operation during the execution of this operation mode, e.g., the operation rod may operate in spite that no force is applied to the operation rod by the limb of the patient.

It is an object of the present invention to suppress an unintended operation of the operation rod when executing an operation mode in which the training device controls the operation of the operation rod based on a force applied to the operation rod.

Technical Solution

As a means for solving the problem, a plurality of embodiments are described below. These embodiments can be arbitrarily combined as necessary.

A training device according to one aspect of the present invention is a training device for training user's upper and/or lower limb in accordance with a predetermined training program.

The training device includes an operation rod, a motor, a force detection unit, a rotation information output sensor, a first command calculation unit, and a force correction unit. It should be noted that the training device may include a plurality of motors, force detection units, rotation information output sensors, first command calculation units, and force correction units.

The operation rod is movably supported by a fixed frame. Therefore, the training device can move a limb held by the operation rod. The fixed frame is placed on a floor surface or close to a floor surface. The motor drives to operate the operation rod in the direction of degree of freedom in which the operation rod can move, on the basis of a motor control command. The force detection unit detects a force component. Then, the force detection unit outputs a force component signal based on a magnitude of the detected force component. The force component is a component of force applied to the operation rod, in the direction of degree of freedom in which the operation rod can move.

The rotation information output sensor detects an operation position of the operation rod based on a rotation amount of the motor. The operation position of the operation rod is a position in the direction of degree of freedom in which the operation rod can move.

The force correction unit calculates a corrected force component value based on the operation position of the operation rod and the force component signal. The first command calculation unit calculates a first motor control command as the motor control command based on the corrected force component value. The first motor control command is a motor control command for controlling a corresponding motor.

In the training device described above, when executing an operation mode (first operation mode) in which the operation rod is operated based on a force applied to the operation rod, the force correction unit calculates the corrected force component value based on the operation position of the operation rod and the force component signal. Then, the first command calculation unit calculates the first motor control command based on the corrected force component value.

In this way, in the training device described above, when executing the first operation mode in which the operation rod is operated based on a force applied to the operation rod, an unintended operation of the operation rod depending on the operation position of the operation rod can be suppressed. It is because the force correction unit calculates the corrected force component value based on the operation position of the operation rod and the force component signal, and the first command calculation unit can calculate the first motor control command based on the corrected force component value.

The force correction unit may calculate the corrected force component value based on a relationship between the operation position of the operation rod and the force correction value. The force correction value is a correction value determined based on the operation position. In this way, the corrected force component value can be calculated by a simpler calculation.

The relationship described above may be expressed by a correction table. The correction table stores the operation position and the force correction value corresponding to the operation position in association with each other. In this way, the force component signal can be corrected more easily using the stored data.

The force correction value at a current operation position of the operation rod may be calculated by linear interpolation using the first force correction value and the second force correction value. The first force correction value is a force correction value associated with a first operation position. The first operation position is an operation position on the correction table, which is smaller than the current operation position of the operation rod. The second force correction value is a force correction value associated with a second operation position. The second operation position is an operation position on the correction table, which is larger than the current operation position of the operation rod.

In this way, the force correction value at an arbitrary operation position of the operation rod can be calculated.

The operation position of the operation rod may be calculated by linear interpolation associated with at least two operation positions except the operation position in the direction of degree of freedom in which the operation rod can move. In this way, the operation position of the operation rod can be calculated more easily.

The force correction unit may calculate the corrected force component value based on the operation position of the operation rod and a weight of the operation rod. In this way, the corrected force component value can be calculated without using the correction table or the like. In addition, the force correction unit may calculate the corrected force component value based on an intermediate length of the operation rod when generating the force correction value data and a length of the operation rod during the operation. In this way, it is possible to perform the correction while taking a length of the operation rod into account.

A correction method according to another aspect of the present invention is a method for correcting a force in a training device including an operation rod, a force detection unit, and a rotation information output sensor. The operation rod moves user's upper and/or lower limb. The force detection unit detects a force component that is a component of a force applied to the operation rod, in the direction of degree of freedom in which the operation rod can move, so as to output a force component signal based on a magnitude of the detected force component. The rotation information output sensor detects an operation position of the operation rod in a corresponding direction of degree of freedom in which the operation rod can move. The method for correcting the force includes:

obtaining the force component signal from the force detection unit;

obtaining the operation position of the operation rod from the rotation information output sensor;

calculating a force correction value based on the operation position of the operation rod; and calculating a corrected force component value that is a corrected value of the force applied to the operation rod by applying the force correction value to a force component value calculated from the force component signal.

In this way, in the training device described above, it is possible to suppress an unintended operation of the operation rod depending on the operation position of the operation rod. It is because it is possible to calculate the corrected force component value that is a value of the force actually applied to the operation rod, on the basis of the operation position of the operation rod and the force component signal.

Advantageous Effects

When the training device executes the operation mode in which the operation of the operation rod is controlled based on a force applied to the operation rod, it is possible to suppress an unintended operation of the operation rod.

BRIEF DESCRIPTION OF DRAWINGS

FIG. 12 is a diagram illustrating a data structure of the calibration data.

FIG. 20 is a diagram illustrating a data structure of a correction table.

DESCRIPTION OF EMBODIMENTS

1. First Embodiment

(1) Overall Structure of a Training Device

Figure 1:
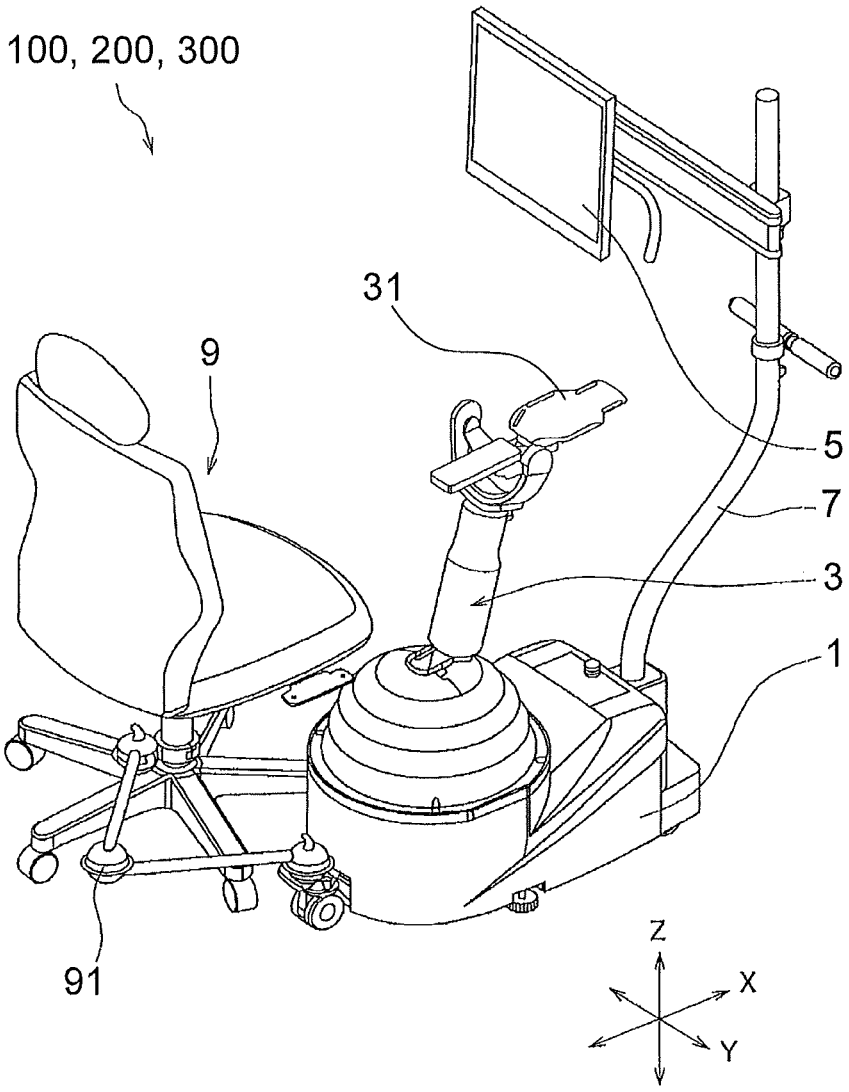
FIG. 1 is a diagram schematically illustrating a training device.

An example of an overall structure of a training device 100 according to a first embodiment is described with reference to FIG. 1. FIG. 1 is a diagram schematically illustrating the training device 100. The training device 100 is a training device for executing training aimed at motor function recovery of upper and/or lower limbs of a user (patient) according to a predetermined training program.

Figure 2:
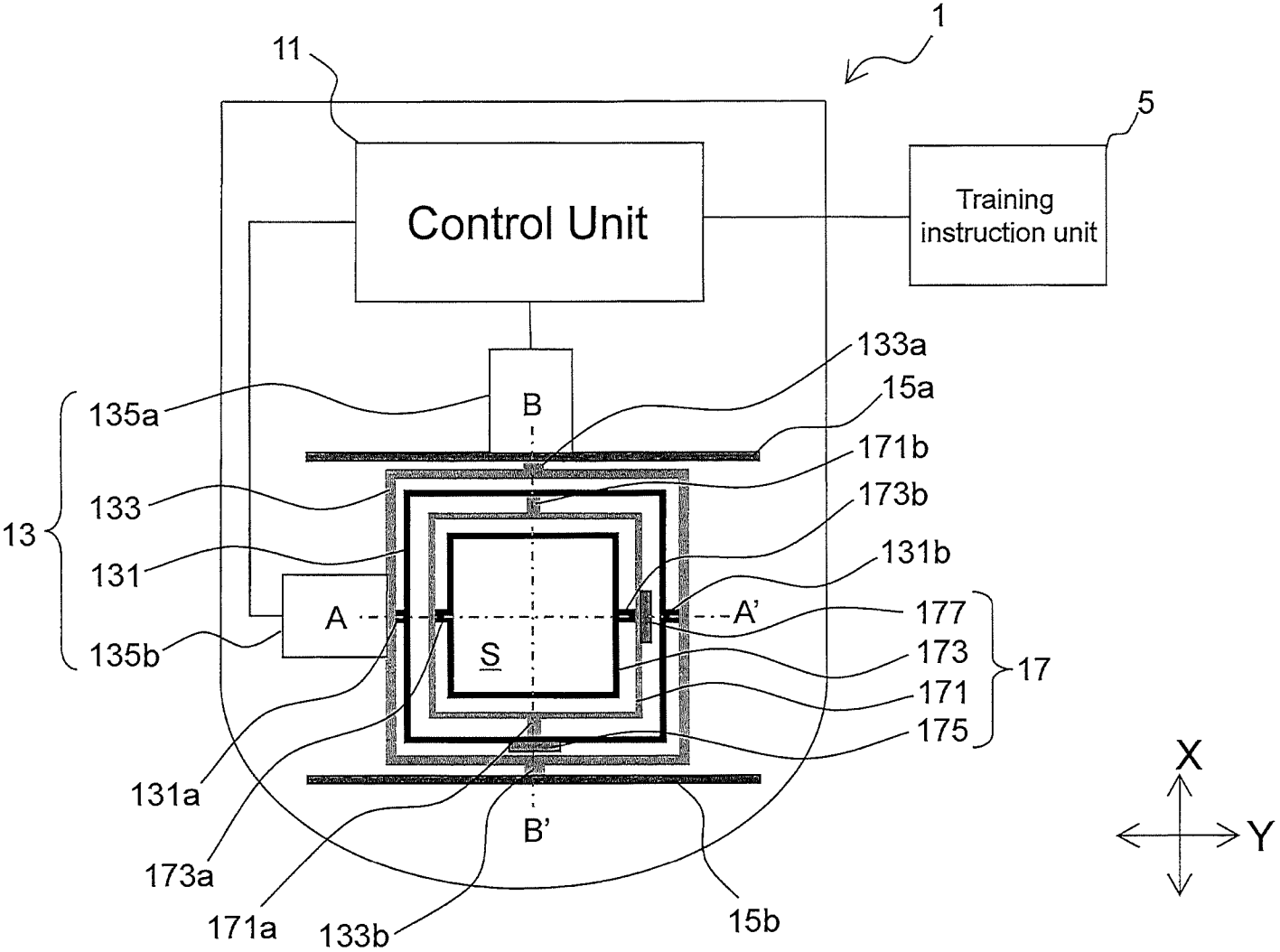
FIG. 2 is a diagram illustrating an overall structure of a control unit and an operation rod tilt mechanism in the fixed frame.

The training device 100 mainly includes a fixed frame 1, an operation rod 3, and a training instruction unit 5. The fixed frame 1 is placed on a floor surface or close to the floor surface on which the training device 100 is installed. In addition, the fixed frame 1 constitutes a main body casing of the training device 100. The operation rod 3 is attached to the fixed frame 1 via an operation rod tilt mechanism 13 (FIG. 2) disposed inside the fixed frame 1. As a result, the operation rod 3 can move (tilt) with the operation rod tilt mechanism 13 in an X-axis direction parallel to a length direction of the fixed frame 1 and in a Y axis direction parallel to a width direction of the fixed frame 1 (FIGS. 1 and 2).

It should be noted that the operation rod 3 may be capable of moving (tilting) only in the X-axis direction or in the Y-axis direction as necessary. In this case, the operation rod 3 can tilt with one degree of freedom.

In addition, the operation rod 3 may internally has a telescoping mechanism (FIG. 4) in the length direction of the operation rod 3. In this case, the operation rod 3 can expand and contract in the length direction of the operation rod 3, and hence can move at least two degrees of freedom or three degrees of freedom together with the operation rod tilt mechanism.

In addition, the operation rod 3 has a limb support member 31 at the upper end. The limb support member 31 supports a limb of the patient so that the operation rod 3 can move the limb of the patient. Alternatively, the patient can move the operation rod 3 intentionally using the limb supported by the limb support member 31.

The training instruction unit 5 is fixed to the fixed frame 1 with a fixing member 7. The training instruction unit 5 executes a preset training program and determines whether to execute the first operation mode or to execute the second operation mode based on the training program. The first operation mode is an operation mode in which the operation rod 3 is controlled to operate on the basis of a force applied to the operation rod 3 by the patient or the like. The second operation mode is an operation mode when the operation of the operation rod 3 is designated in the training program. In other words, the second operation mode is a mode in which the operation rod 3 is controlled to operate based on a training instruction according to the training program.

In addition, the training instruction unit 5 provides training movements of the limb of the patient in a training route and an actual route as visual information or auditory information according to the preset training program. In this way, the patient can perform training of the limb with feedback of the training movement set by the training program and the actual operation.

Further, if the limb of the patient can tilt the operation rod 3 to a target point (target tilt angle) indicated in the training program, the training instruction unit 5 may notify the user that the target tilt angle is reached, by means of the visual information or the auditory information. In this way, the patient can maintain motivation to continue the training.

As the training instruction unit 5, it is possible to use an integrated computer system including a display device such as a liquid crystal display, a central processing unit (CPU), a random access memory (RAM), a read only memory (ROM), a storage device such as a hard disk or a solid state disk (SSD), and an input device such as a touch panel, as necessary. In addition, the training instruction unit 5 may include a display device and other parts of the computer system, which are separated from each other. In this case, the display device is fixed to the fixed frame 1 with the fixing member 7.

The training program executed by the training instruction unit 5 has, for example, five training modes or the like, including (i) Guided Mode, (ii) Initiated Mode, (iii) Step Initiated Mode, (iv) Follow Assist Mode, and (v) Free Mode. The Guided Mode is a training mode in which the operation rod 3 moves the limb at a constant speed in a predetermined direction regardless of a movement of the limb of the patient. The Initiated Mode is a training mode in which a force that the patient intends to move the operation rod 3 in a correct direction with the limb at an initial position with respect to the training route preset in the training program (which may be referred to as a force sense trigger) is detected, and the operation rod 3 moves the limb of the patient at a constant speed in a direction of the predetermined training route. The Step Initiated Mode is a training mode in which, when the force sense trigger is detected at a predetermined position in the training route of the operation rod 3, the operation rod 3 moves the limb of the patient only a certain distance in the training route. The Follow Assist Mode is a training mode in which the force sense trigger is detected every predetermined period so that the speed of the operation rod 3 is changed in accordance with magnitude of the detected force sense trigger. The Free Mode is a training mode in which the operation rod 3 is moved to follow the movement of the limb of the patient.

Among the five training modes described above, the Free Mode is included in the first operation mode. On the other hand, other training modes are included in the second operation mode. In other words, the first operation mode is an operation mode in which the operation direction and/or the operation speed of the operation rod 3 are determined based on movement of the limb of the patient (namely the force applied to the operation rod 3 by the limb of the patient). On the other hand, the second operation mode is an operation mode in which a main operation (the operation direction/speed) of the operation rod 3 is instructed based on the designated training instruction in the training program, but the detection of the force may be necessary in an initial stage of the operation.

In addition, the training device 100 may further include a chair 9 on which the patient sits during the training. Further, the chair 9 may be connected to the fixed frame 1 with a chair connecting member 91. By connecting the chair 9 to the fixed frame 1 with the chair connecting member 91, it is possible to secure the stability of the training device 100 and to fix the chair 9 with high repeatability. As a result, the patient can perform the training at the same position every time.

(2) Structure of Control Unit and Operation Rod Tilt Mechanism

I. Overall Structure

Next, the overall structures of a control unit 11 and the operation rod tilt mechanism 13 are described with reference to FIG. 2. FIG. 2 is a diagram illustrating overall structures of the control unit and the operation rod tilt mechanism in the fixed frame. The control unit 11 and the operation rod tilt mechanism 13 are disposed in the fixed frame 1.

The control unit 11 is connected to the training instruction unit 5 so that signals can be transmitted and received between them. The control unit 11 receives either a first operation mode execution instruction for executing the first operation mode or a second operation mode execution instruction for executing the second operation mode, from the training instruction unit 5. In addition, when executing the second operation mode in particular, the control unit 11 receives a training instruction of the operation rod.

In addition, the control unit 11 is electrically connected to an X-axis direction tilt motor 135*b*, a Y-axis direction tilt motor 135*a* and a telescoping motor 359. Therefore, the control unit 11 can determine the operation mode in which the motors should be controlled, on the basis of the received first operation mode execution instruction or the received second operation mode execution instruction.

In addition, when executing the first operation mode, the control unit 11 calculates a first motor control command based on the force applied to the operation rod 3 by the patient or the like and outputs the first motor control command. On the other hand, when executing the second operation mode, the control unit 11 first calculates an operation command based on the training instruction of the operation rod 3. Next, the control unit 11 calculates a second motor control command based on the operation command and outputs the second motor control command. In this way, the control unit 11 can generates and selects an appropriate motor control command in accordance with the plurality of training programs (or the first operation mode and the second operation mode) described above. As a result, the training device 100 can appropriately operate the operation rod 3 in accordance with the training program (operation mode).

It should be noted that the structure and operation of the control unit 11 will be described later in detail.

Figure 3A:
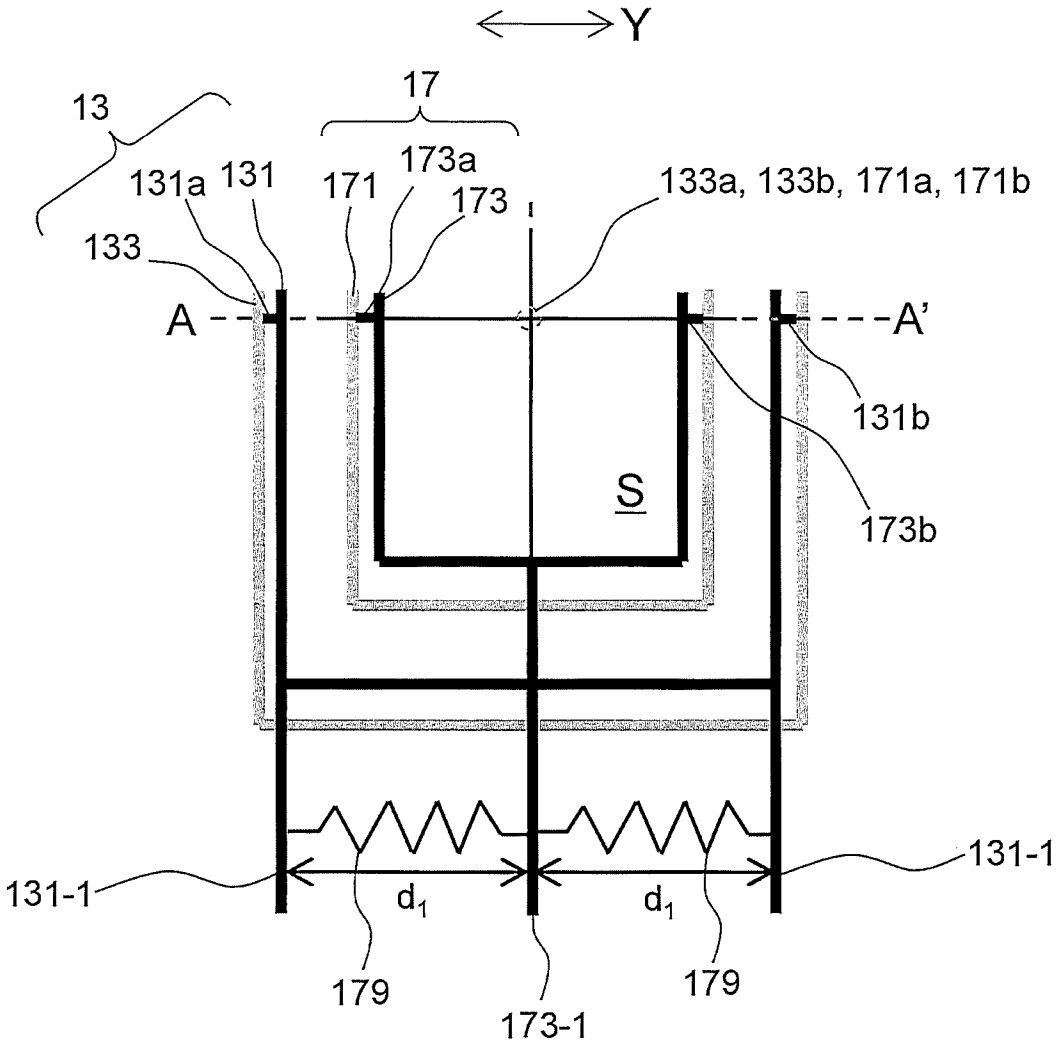
FIG. 3A is a cross-sectional view of the operation rod tilt mechanism and a force detection mechanism in an A-A' plane.
Figure 3B:
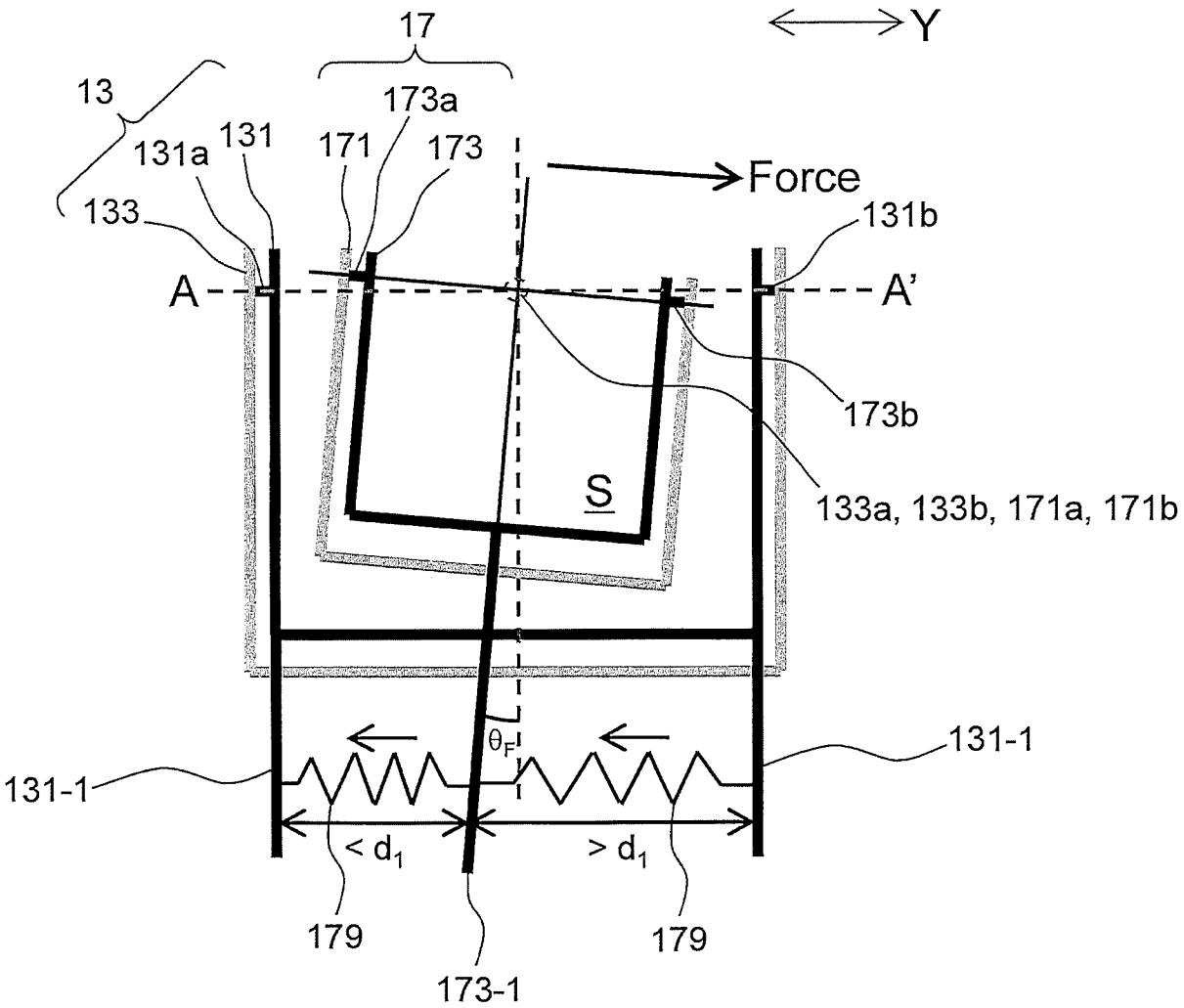
FIG. 3B is a diagram illustrating a relationship between the operation rod tilt mechanism and the force detection mechanism when a force in a Y-axis direction is applied to an operation rod.

The operation rod tilt mechanism 13 is attached to the fixed frame 1 in a tiltable manner via operation rod tilt mechanism fixing members 15*a* and 15*b* fixed to the fixed frame 1. Therefore, the operation rod tilt mechanism 13 allows the operation rod 3 to tilt in the X-axis direction and in the Y-axis direction (two degrees of freedom). In addition, the operation rod tilt mechanism 13 is further equipped with a force detection mechanism 17 (FIGS. 2 to 3B). In this way, the force applied to the operation rod 3 can be detected.

It should be noted that the operation rod tilt mechanism 13 may be configured so that the operation rod 3 can tilt only in the X-axis direction or the Y-axis direction (one degree of freedom). Alternatively, the operation rod tilt mechanism 13 may be capable of setting to select whether to tilt the operation rod 3 with one degree of freedom or with two degrees of freedom.

A structure of the operation rod tilt mechanism 13 is described below in detail.

II. Structure of Operation Rod Tilt Mechanism

Here, a structure of the operation rod tilt mechanism 13 of this embodiment is described with reference to FIG. 2. The operation rod tilt mechanism 13 is a mechanism that enables the operation rod 3 to tilt in the X-axis direction and in the Y-axis direction with a "gimbal" mechanism that enables two-axis movement. Here, the X-axis direction is a horizontal direction parallel to the axis in up and down direction in FIG. 2. The Y-axis direction is a horizontal direction parallel to the axis in left and right direction in FIG. 2.

The operation rod tilt mechanism 13 includes an X-axis direction tilt member 131 and a Y-axis direction tilt member 133, and the corresponding X-axis direction tilt motor 135*b* and Y-axis direction tilt motor 135*a*, and the force detection mechanism 17.

It should be noted that, when the operation rod tilt mechanism 13 tilts the operation rod 3 with one degree of freedom, it is sufficient that the operation rod tilt mechanism 13 includes only the X-axis direction tilt member 131 and the X-axis direction tilt motor 135*b*, or the Y-axis direction tilt member 133 and the Y-axis direction tilt motor 135*a*. Alternatively, in the case where the operation rod tilt mechanism 13 includes the two members and the corresponding two motors described above, by disabling one of the combinations of the member and the motor, the operation rod tilt mechanism 13 can tilt the operation rod 3 with one degree of freedom.

The X-axis direction tilt member 131 is disposed in a space of the Y-axis direction tilt member 133. In addition, the X-axis direction tilt member 131 includes two shafts 131*a* and 131*b* extending outward from side surfaces having normals parallel to the Y axis. Each of the two shafts 131*a* and 131*b* is supported by each of the side surfaces of the Y-axis direction tilt member 133 having normals parallel to the Y axis so that the X-axis direction tilt member 131 can tilt with respect to the Y axis. In this way, the X-axis direction tilt member 131 can cause the operation rod 3 to change the angle between the operation rod 3 fixed to the force detection mechanism 17 and the X axis. Here, the operation of changing the angle between the operation rod 3 and the X axis may also be referred to as "tilt in the X-axis direction".

Similarly, the Y-axis direction tilt member 133 includes two shafts 133*a* and 133*b* extending outward from two side surfaces having normals parallel to the X axis. Each of the two shafts 133*a* and 133*b* is supported by each of the operation rod tilt mechanism fixing members 15*a* and 15*b* so that the Y-axis direction tilt member 133 can tilt about the X axis. In this way, the Y-axis direction tilt member 133 can rotate about the X axis with respect to the operation rod tilt mechanism fixing members 15*a* and 15*b*. As a result, the Y-axis direction tilt member 133 can perform an operation of changing the angle between the operation rod 3 fixed to the force detection mechanism 17 and the Y axis to the operation rod 3. Here, the operation of changing the angle between the operation rod 3 and the Y axis may also be referred to as "tilt in the Y-axis direction".

In this way, the Y-axis direction tilt member 133 tilts the operation rod 3 in the Y-axis direction, while the X-axis direction tilt member 131 tilts the operation rod 3 in the X-axis direction. Therefore, the operation rod tilt mechanism 13 can tilt the operation rod 3 with two degrees of freedom. It should be noted that the X-axis direction tilt member 131 is disposed in a space of the Y-axis direction tilt member 133 in FIG. 2, but it is possible to change the design so that the X-axis direction tilt member 131 is disposed outside the space of the Y-axis direction tilt member 133 so that a corresponding member can tilt.

The Y-axis direction tilt motor 135*a* is fixed to the operation rod tilt mechanism fixing member 15*a*. In addition, the output rotation shaft of the Y-axis direction tilt motor 135*a* is connected to the shaft 133*a* extending from the Y-axis direction tilt member 133 via a speed reduction mechanism (not shown) so as to rotate the shaft 133*a*. Thus, the Y-axis direction tilt motor 135*a* rotates the Y-axis direction tilt member 133 about the X axis. Further, the Y-axis direction tilt motor 135*a* is electrically connected to the control unit 11. Thus, the Y-axis direction tilt motor 135*a* can tilt the operation rod 3 in the Y-axis direction with control by the control unit 11.

The X-axis direction tilt motor 135*b* is fixed to the side surface at which the shaft 131*a* extending from the X-axis direction tilt member 131 is pivotally supported, among four side surfaces of the Y-axis direction tilt member 133. In addition, the output rotation shaft of the X-axis direction tilt motor 135*b* is connected to the shaft 131*a* extending from the X-axis direction tilt member 131 via the speed reduction mechanism (not shown) so as to rotate the shaft 131*a*. Thus, the X-axis direction tilt motor 135*b* can rotate the X-axis direction tilt member 131 about the Y axis. Further, the X-axis direction tilt motor 135*b* is electrically connected to the control unit 11. Thus, the X-axis direction tilt motor 135*b* can tilt the operation rod 3 in the X-axis direction with control by the control unit 11.

In this way, the Y-axis direction tilt motor 135*a* and the X-axis direction tilt motor 135*b* respectively tilt the operation rod 3 in the Y-axis direction and in the X-axis direction with one degree of freedom with control by the control unit 11. In other words, the X-axis direction tilt motor 135*b* and the Y-axis direction tilt motor 135*a* are provided for controlling the operation rod 3 in a two-dimensional manner.

As the Y-axis direction tilt motor 135*a* and the X-axis direction tilt motor 135*b*, an electric motor such as a servo motor or a brushless motor is used, for example.

The force detection mechanism 17 is pivoted at the X-axis direction tilt member 131 in a manner rotatable about the X axis. Thus, the force detection mechanism 17 can tilt (operate) in the Y-axis direction with respect to the X-axis direction tilt member 131. In addition, the force detection mechanism 17 is connected to the X-axis direction tilt member 131 via a biasing member 179 of the force detection mechanism 17.

III. Structure of Force Detection Mechanism

Next, details of the structure of the force detection mechanism 17 are described with reference to FIGS. 2 and 3A. FIG. 3A is a cross-sectional view of the operation rod tilt mechanism 13 and the force detection mechanism 17 taken along the A-A' plane. As illustrated in FIG. 2, similarly to the operation rod tilt mechanism 13, the force detection mechanism 17 is a mechanism that enables the operation rod 3 to tilt in the X-axis direction and in the Y-axis direction with the "gimbal" mechanism that enables two-axis movement.

Therefore, the force detection mechanism 17 includes a Y-axis direction force detection member 171, an X-axis direction force detection member 173, a Y-axis direction force detection unit 175, an X-axis direction force detection unit 177, and the biasing member 179.

The Y-axis direction force detection member 171 includes two shafts 171*a* and 171*b* extending outward from two side surfaces having normals parallel to the X axis. Each of the two shafts 171*a* and 171*b* is supported by the X-axis direction tilt member 131 so as to rotate about the X axis. In this way, the Y-axis direction force detection member 171 can rotate about the X axis with respect to the X-axis direction tilt member 131. As a result, the Y-axis direction force detection member 171 can change a relative tilt angle with respect to the X-axis direction tilt member 131.

The X-axis direction force detection member 173 includes two shafts 173*a* and 173*b* extending outward from two side surfaces having normals parallel to the Y axis. Each of the two shafts 173*a* and 173*b* is supported by the Y-axis direction force detection member 171 so as to rotate about the Y axis. In this way, the X-axis direction force detection member 173 can rotate about the Y axis with respect to the Y-axis direction force detection member 171. As a result, the X-axis direction force detection member 173 can change a relative tilt angle with respect to the Y-axis direction force detection member 171.

In addition, the X-axis direction force detection member 173 includes a space S and an operation rod fixing portion (not shown). The operation rod 3 is inserted into the space S and fixed to the X-axis direction force detection member 173 with the operation rod fixing portion.

The Y-axis direction force detection unit 175 includes a rotatable shaft (rotation shaft) and outputs a signal based on a rotation amount of the rotation shaft (force component signal). The Y-axis direction force detection unit 175 is fixed to the X-axis direction tilt member 131 so that the rotation shaft coincides with the shaft 171*a* or 171*b* of the Y-axis direction force detection member 171. In this way, the Y-axis direction force detection unit 175 can detect the relative tilt angle with respect to the X-axis direction tilt member 131.

As described later, the relative tilt angle of the Y-axis direction force detection member 171 with respect to the X-axis direction tilt member 131 viewed from the A-A' plane is an angle corresponding to a force component in the Y-axis direction of the force applied to the operation rod 3. Thus, the Y-axis direction force detection unit 175 detects the force component in the Y-axis direction by detecting the relative tilt angle of the Y-axis direction force detection member 171 with respect to the X-axis direction tilt member 131, and it can output the force component signal that is a signal based on the detected force component.

The X-axis direction force detection unit 177 includes the rotatable shaft (rotation shaft) and outputs the signal based on a rotation amount of the rotation shaft (force component signal). The X-axis direction force detection unit 177 is fixed to the Y-axis direction force detection member 171 so that the rotation shaft coincides with the shaft 173*a* or 173*b* of the X-axis direction force detection member 173. In this way, the X-axis direction force detection unit 177 can detect the relative tilt angle of X-axis direction force detection member 173 with respect to the Y-axis direction force detection member 171.

Similarly to the Y-axis direction force detection unit 175 described above, the relative tilt angle of the X-axis direction force detection member 173 with respect to the Y-axis direction force detection member 171 viewed from the B-B' plane of FIG. 2 is an angle corresponding to a force component in the X-axis direction of the force applied to the operation rod 3. Thus, the X-axis direction force detection unit 177 detects the force component in the X-axis direction by detecting the relative tilt angle of the X-axis direction force detection member 173 with respect to the Y-axis direction force detection member 171, and it can output the force component signal that is a signal based on the detected force component.

As the above-mentioned Y-axis direction force detection unit 175 and X-axis direction force detection unit 177 capable of outputting the signal based on the rotation amount of the rotation shaft, there is a potentiometer, for example. If potentiometers are used as the Y-axis direction force detection unit 175 and the X-axis direction force detection unit 177, each of the Y-axis direction force detection unit 175 and the X-axis direction force detection unit 177 can output a signal representing the rotation amount of the rotation shaft of the Y-axis direction force detection unit 175 or the X-axis direction force detection unit 177 (force component signal).

The biasing member 179 is constituted of a plurality of leaf springs having a spiral shape, for example. As illustrated in FIG. 3A, a connection end at the center of the spiral of the spiral-shaped spring constituting the biasing member 179 is fixed to a biasing member fixing portion 173-1 disposed at the center of the X-axis direction force detection member 173. In addition, a connection end at the outermost circumference portion of the spiral-shaped spring constituting the biasing member 179 is fixed to a biasing member fixing portion 131-1 provided to the X-axis direction tilt member 131.

When the operation rod tilt mechanism 13 and the force detection mechanism 17 are connected to each other as described above, if a force in the right direction in the Y-axis direction is applied to the operation rod 3, for example, the biasing member 179 is deformed by the force applied to the operation rod 3 as illustrated in FIG. 3B. FIG. 3B is a diagram illustrating a relationship between the operation rod tilt mechanism and the force detection mechanism when a force in the Y-axis direction is applied to the operation rod.

Supposing that the radius of the biasing member 179 is $d_1$ when no force is applied to the operation rod 3 and a force in the right direction in the Y-axis direction (in the paper surface of FIG. 3B) is applied to the operation rod 3, the left side part of the biasing member 179 from the biasing member fixing portion 173-1 is compressed so that the length becomes smaller than the radius $d_1$. On the other hand, the right side part of the biasing member 179 from the biasing member fixing portion 173-1 is expanded so that the length becomes larger than the radius $d_1$. The compressed length and the expanded length of the spring are determined by the force applied to the operation rod 3.

In this case, because of the deformation of the biasing member 179 described above, the force detection mechanism 17 (the Y-axis direction force detection member 171 thereof) is displaced by a tilt angle $\theta_F$ with respect to the operation rod tilt mechanism 13. The deformation degree of the biasing member 179 (the compressed length and the expanded length due to the deformation) is determined by the force applied to the operation rod 3. Therefore, by detecting the above-mentioned tilt angle $\theta_F$ with the Y-axis direction force detection unit 175, the force component in the Y-axis direction of the force applied to the operation rod 3 can be detected. The above description can be similarly applied to the force component in the X-axis direction.

Further, when executing the first operation mode in which the operation rod 3 is operated based on the force applied to the operation rod 3 by the patient or the like, the control unit 11 monitors variation of the tilt angle θF (force component signal) described above and controls the Y-axis direction tilt motor 135*a* and the X-axis direction tilt motor 135*b* based on the variation of the tilt angle θF, i.e., the variation of the force component signal.

(3) Structure of Operation Rod

I. Overall Structure

Figure 4:
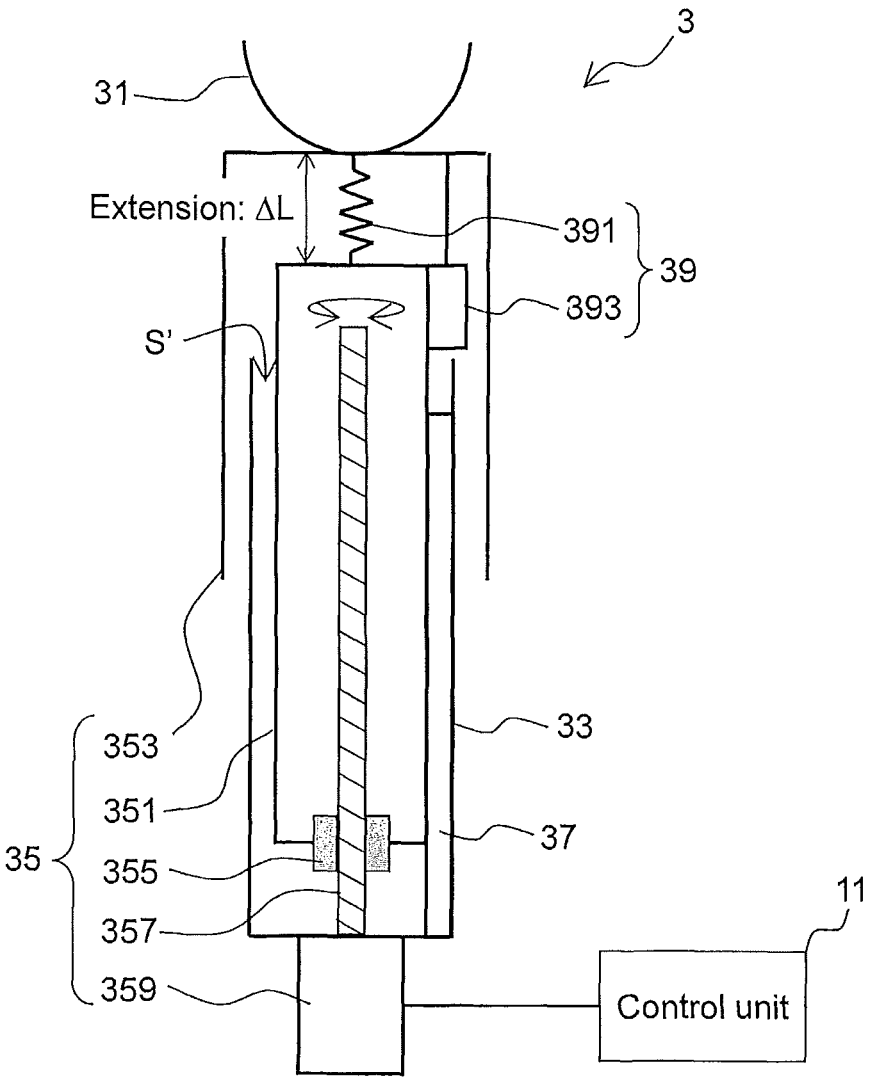
FIG. 4 is a diagram illustrating a structure of the operation rod.

Next, A structure of the operation rod 3 is described with reference to FIG. 4. First, an overall structure of the operation rod 3 is described. The operation rod 3 includes the limb support member 31, a fixed stay 33, and a telescoping mechanism 35. The limb support member 31 is fixed to the upper end of a cover 353 of the telescoping mechanism 35. The limb support member 31 is a member that supports the limb of the patient. The fixed stay 33 constitutes a main body of the operation rod 3. In addition, the fixed stay 33 has a space S' for housing a movable stay 351 of the telescoping mechanism 35. Further, the fixed stay 33 includes a fixing member (not shown) for fixing the operation rod 3 to the X-axis direction force detection member 173. By fixing the fixed stay 33 to the X-axis direction force detection member 173 with the fixing member of the fixed stay 33, the operation rod 3 is fixed to the force detection mechanism 17.

The telescoping mechanism 35 is provided to the fixed stay 33 so as to move along the length direction of the operation rod 3. In this way, the operation rod 3 can expand and contract in the length direction of the operation rod 3. The structure of the telescoping mechanism 35 is described below in detail.

II. Structure of Telescoping Mechanism

Next, the structure of the telescoping mechanism 35 is described with reference to FIG. 4. The telescoping mechanism 35 includes the movable stay 351, the cover 353, a nut 355, a threaded shaft 357, the telescoping motor 359, and a length direction force detection unit 39.

The movable stay 351 is inserted into the space S' formed in the fixed stay 33. In addition, the movable stay 351 includes a slide unit (not shown). This slide unit is slidably engaged with a guide rail 37 disposed on an inner wall of the fixed stay 33. As a result, the movable stay 351 can move along the guide rail 37 (namely in the length direction of the operation rod 3) in the space S' of the fixed stay 33. The cover 353 is connected to the upper end of the movable stay 351 with a biasing member 391. In this way, the cover 353 can move in accordance with the movement of the movable stay 351. In addition, the cover 353 includes the limb support member 31 disposed at the upper end. Thus, the cover 353 can move the limb support member 31 in the expanding direction of the fixed stay 33.

The nut 355 is attached to the bottom of the movable stay 351. The nut 355 is engaged with the threaded shaft 357. The threaded shaft 357 is a threaded member extending in parallel to the extending direction of the fixed stay 33. In addition, the threaded shaft 357 is screwed with the nut 355. Thus, when the threaded shaft 357 rotates, it moves the nut 355 along the extending direction of the threaded shaft 357 (namely the extending direction (length direction) of the fixed stay 33).

As described above, because the nut 355 is fixed to the bottom of the movable stay 351, when the nut 355 moves along the extending direction of the threaded shaft 357, the movable stay 351 can move along the extending direction (length direction) of the fixed stay 33.

The telescoping motor 359 is fixed to the bottom of the fixed stay 33. In addition, the output rotation shaft of the telescoping motor 359 is connected to an end in the length direction of the threaded shaft 357 so that the threaded shaft 357 can rotate about the axis of the threaded shaft 357. Further, the telescoping motor 359 is electrically connected to the control unit 11. Thus, the telescoping motor 359 can rotate the threaded shaft 357 about the axis of the threaded shaft 357 with control by the control unit 11.

As described above, because the nut 355 is screwed with the threaded shaft 357, the nut 355 can move along the extending direction of the threaded shaft 357 in accordance with the rotation of the threaded shaft 357. Thus, the movable stay 351 can move along the extending direction (length direction) of the fixed stay 33 in accordance with the rotation of the telescoping motor 359.

The length direction force detection unit 39 detects force applied to the operation rod 3 in the length direction by the limb of the patient. Specifically, the length direction force detection unit 39 detects extension ΔL of the biasing member 391 (e.g., a spring) having an end fixed to the cover 353 and the other end fixed to the movable stay 351 with an expansion detection unit 393 (a linear action potentiometer in this embodiment), so as to calculate and detect the force in the length direction using a preset relationship between the force in the length direction and the extension of the biasing member 391.

When a linear action potentiometer is used as the expansion detection unit 393, a length direction force component signal representing a force component in the length direction is obtained as an output voltage of the linear action potentiometer, which varies in accordance with the extension ΔL of the biasing member 391.

(4) Structure of Control Unit

I. Overall Structure

Figure 5:
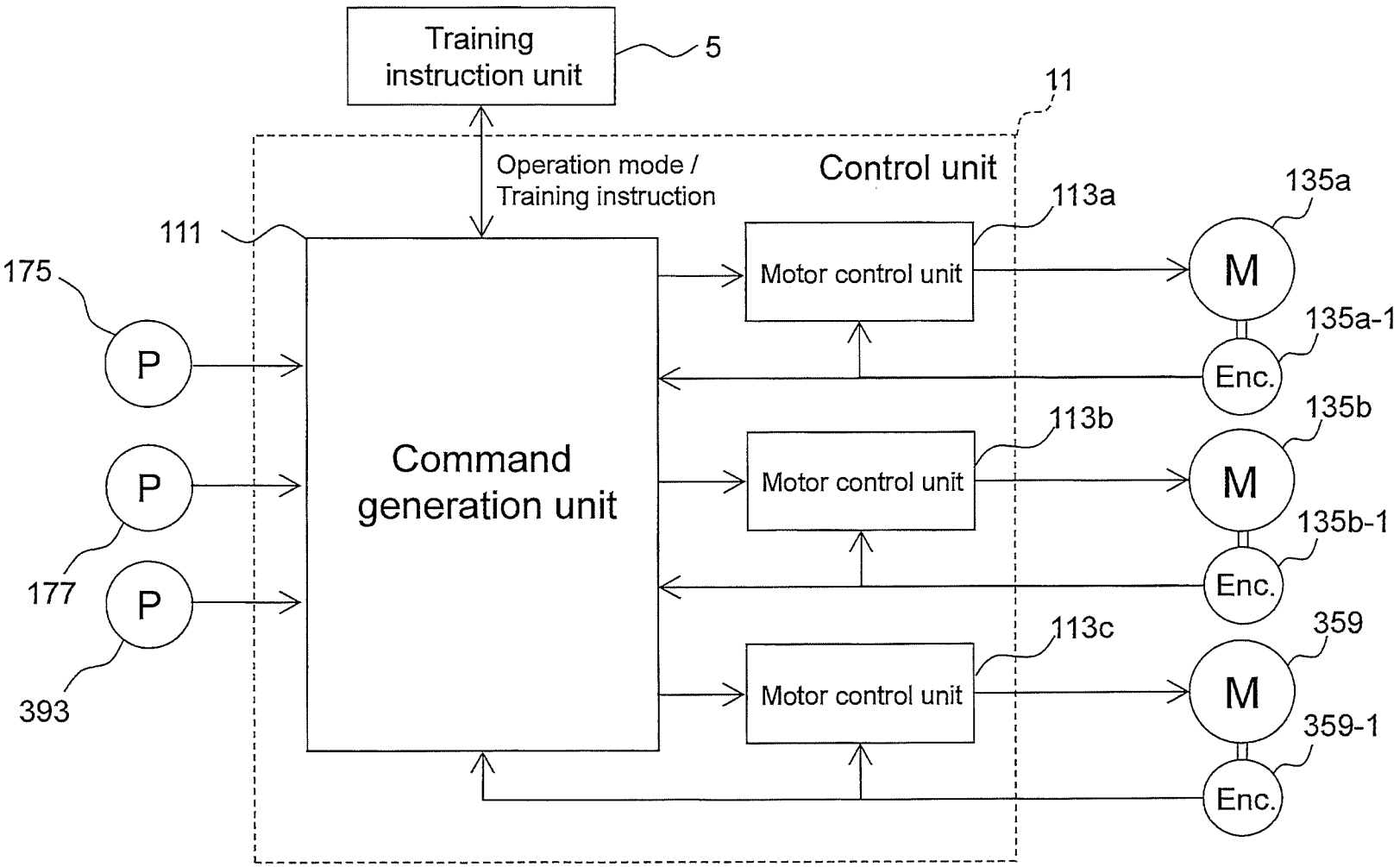
FIG. 5 is a diagram illustrating an overall structure of the control unit.

Next, an overall structure of the control unit 11 is described with reference to FIG. 5, in which a three-degree-of-freedom system is exemplified. As the control unit 11, it is possible to use, for example, one or more microcomputer systems including a CPU, a storage device such as a RAM, a ROM, a hard disk device, and an SSD, and an interface for converting an electric signal. In addition, a part or a whole of the functions of the control unit 11 described below may be realized as a program that can be executed by the microcomputer system. In addition, the program may be stored in the storage device of the microcomputer system. Further, a part or a whole of the functions of the control unit 11 may be realized by one or more custom ICs or the like.

The control unit 11 includes a command generation unit 111 and motor control units 113*a*, 113*b*, and 113*c*, for example.

The command generation unit 111 is connected to the training instruction unit 5 in a manner capable of transmitting and receiving signals. The command generation unit 111 determines the operation mode in which the Y-axis direction tilt motor 135*a*, the X-axis direction tilt motor 135*b*, and the telescoping motor 359 should be controlled, on the basis of the first operation mode execution instruction or the second operation mode execution instruction transmitted from the training instruction unit 5. In addition, when executing the second operation mode, the command generation unit 111 receives the training instruction of the operation rod 3 from the training instruction unit 5. In this way, the command generation unit 111 can calculate the motor control command for controlling the above-mentioned motors (second motor control command), on the basis of the training instruction of the operation rod 3 (operation command) when executing the second operation mode.

In addition, the command generation unit 111 is electrically connected to the Y-axis direction force detection unit 175, the X-axis direction force detection unit 177, and the expansion detection unit 393. In this way, the command generation unit 111 can receive the X-axis direction force component signal representing a force component in the X-axis direction, the Y-axis direction force component signal representing a force component in the Y-axis direction, and the length direction force component signal representing a force component in the length direction of the operation rod 3. As a result, when executing the first operation mode, the command generation unit 111 can calculate the motor control command (first motor control command) for controlling the motors based on the X-axis direction force component signal, the Y-axis direction force component signal, and the length direction force component signal.

Other than that, when executing the second operation mode, the command generation unit 111 may use the X-axis direction force component signal, the Y-axis direction force component signal, and the length direction force component signal, as the force sense trigger, as necessary.

Further, the command generation unit 111 is connected to the motor control units 113*a*, 113*b*, and 113*c* in a manner capable of transmitting and receiving signals. In this way, the command generation unit 111 can output the command (motor control command) to each of the motor control units 113*a*, 113*b*, and 113*c* so as to control the Y-axis direction tilt motor 135*a*, the X-axis direction tilt motor 135*b*, and the telescoping motor 359, respectively.

The command generation unit 111 of this embodiment determines the motor control command to be output based on the operation mode to be executed. Specifically, when executing the first operation mode in which the operation rod 3 is operated based on a force applied to the operation rod 3, the command generation unit 111 outputs the motor control command that is the first motor control command calculated based on the X-axis direction force component signal, the Y-axis direction force component signal, and the length direction force component signal.

On the other hand, when executing the second operation mode in which the operation rod 3 is operated based on the training instruction instructed in the training program, the command generation unit 111 outputs the motor control command that is the second motor control command calculated based on the training instruction (operation command).

In this way, the command generation unit 111 can output an appropriate motor control command in accordance with the operation mode (training program) that is being executed. As a result, the training device 100 can appropriately operate the operation rod 3 in accordance with the training program (operation mode).

In addition, the command generation unit 111 is connected to a first rotation information output sensor 135*a*-1, a second rotation information output sensor 135*b*-1, and a third rotation information output sensor 359-1 in a manner capable of transmitting and receiving signals. In this way, the command generation unit 111 can know the rotation amounts of the Y-axis direction tilt motor 135*a*, the X-axis direction tilt motor 135*b*, and the telescoping motor 359, on the basis of pulse signals output from the first rotation information output sensor 135*a*-1, the second rotation information output sensor 135*b*-1, and the third rotation information output sensor 359-1, respectively. As a result, the command generation unit 111 can control the operation rod 3 while monitoring the position of the operation rod 3 (the tilt angle and the operation rod length) based on the rotation amounts of the three motors described above. Specifically, the command generation unit 111 can control the operation rod 3, while monitoring the position of the operation rod 3 so as to monitor whether or not the operation rod 3 is within the designated operating range.

It should be noted that details of the structure of the command generation unit 111 will be described later.

The motor control units 113*a*, 113*b*, and 113*c* are connected to the command generation unit 111 in a manner capable of transmitting and receiving signals. Therefore, the motor control units 113*a*, 113*b*, and 113*c* can receive the motor control command from the command generation unit 111. In addition, the motor control units 113*a*, 113*b*, and 113*c* are electrically connected to the Y-axis direction tilt motor 135*a*, the X-axis direction tilt motor 135*b*, and the telescoping motor 359, respectively. Thus, the motor control units 113*a*, 113*b*, and 113*c* can control the corresponding motors based on the received motor control command.

Further, the motor control units 113*a*, 113*b*, and 113*c* are respectively connected to the first rotation information output sensor 135*a*-1 for the Y-axis direction tilt motor 135*a*, the second rotation information output sensor 135*b*-1 for the X-axis direction tilt motor 135*b*, the third rotation information output sensor 359-1 for the telescoping motor 359 in a manner capable of transmitting and receiving signals.

The first rotation information output sensor 135*a*-1, the second rotation information output sensor 135*b*-1, and the third rotation information output sensor 359-1 are respectively fixed to the output rotation shaft of the Y-axis direction tilt motor 135*a*, the output rotation shaft of the X-axis direction tilt motor 135*b*, and the output rotation shaft of the telescoping motor 359. In this way, the first rotation information output sensor 135*a*-1, the second rotation information output sensor 135*b*-1, and the third rotation information output sensor 359-1 can output the rotation amount of the Y-axis direction tilt motor 135*a*, the rotation amount of the X-axis direction tilt motor 135*b*, and the rotation amount of the telescoping motor 359, respectively. As a result, the first rotation information output sensor 135*a*-1, the second rotation information output sensor 135*b*-1, and the third rotation information output sensor 359-1 can detect operation positions of the operation rod 3 corresponding to directions of degree of freedom in which the operation rod 3 can operate, on the basis of the rotation amount of the Y-axis direction tilt motor 135*a*, the rotation amount of the X-axis direction tilt motor 135*b*, and the rotation amount of the telescoping motor 359, respectively.

Specifically, the first rotation information output sensor 135*a*-1 can detect the operation position (tilt angle) of the operation rod 3 in the Y-axis direction based on the rotation amount of the Y-axis direction tilt motor 135*a*. In addition, the second rotation information output sensor 135*b*-1 can detect the operation position (tilt angle) of the operation rod 3 in the X-axis direction based on the rotation amount of the X-axis direction tilt motor 135*b*. Further, the third rotation information output sensor 359-1 can detect the operation position of the operation rod 3 in the length direction based on the rotation amount of the telescoping motor 359.

As the first rotation information output sensor 135*a*-1, the second rotation information output sensor 135*b*-1, and the third rotation information output sensor 359-1, it is possible to use a sensor capable of measuring rotation amount of an output rotation shaft of a motor. As such sensor, for example, an encoder such as an incremental type encoder or an absolute type encoder can be appropriately used. When an encoder is used as the sensor, the first rotation information output sensor 135*a*-1, the second rotation information output sensor 135*b*-1, and the third rotation information output sensor 359-1 output pulse signals corresponding to the rotation amount of the Y-axis direction tilt motor 135*a*, the rotation amount of the X-axis direction tilt motor 135*b*, and the rotation amount of the telescoping motor 359, respectively.

In this way, because the motor control units 113*a*, 113*b*, and 113*c* are connected to the first rotation information output sensor 135*a*-1, the second rotation information output sensor 135*b*-1, and the third rotation information output sensor 359-1 for measuring rotation amounts of the output rotation shafts of the motors, the motor control units 113*a*, 113*b*, and 113*c* can control the motors in consideration of real motor rotation amounts or the like. As the motor control units 113*a*, 113*b*, and 113*c*, it is possible to use a motor control device (motor control circuit) or the like using feedback control theory, for example.

Figure 6:
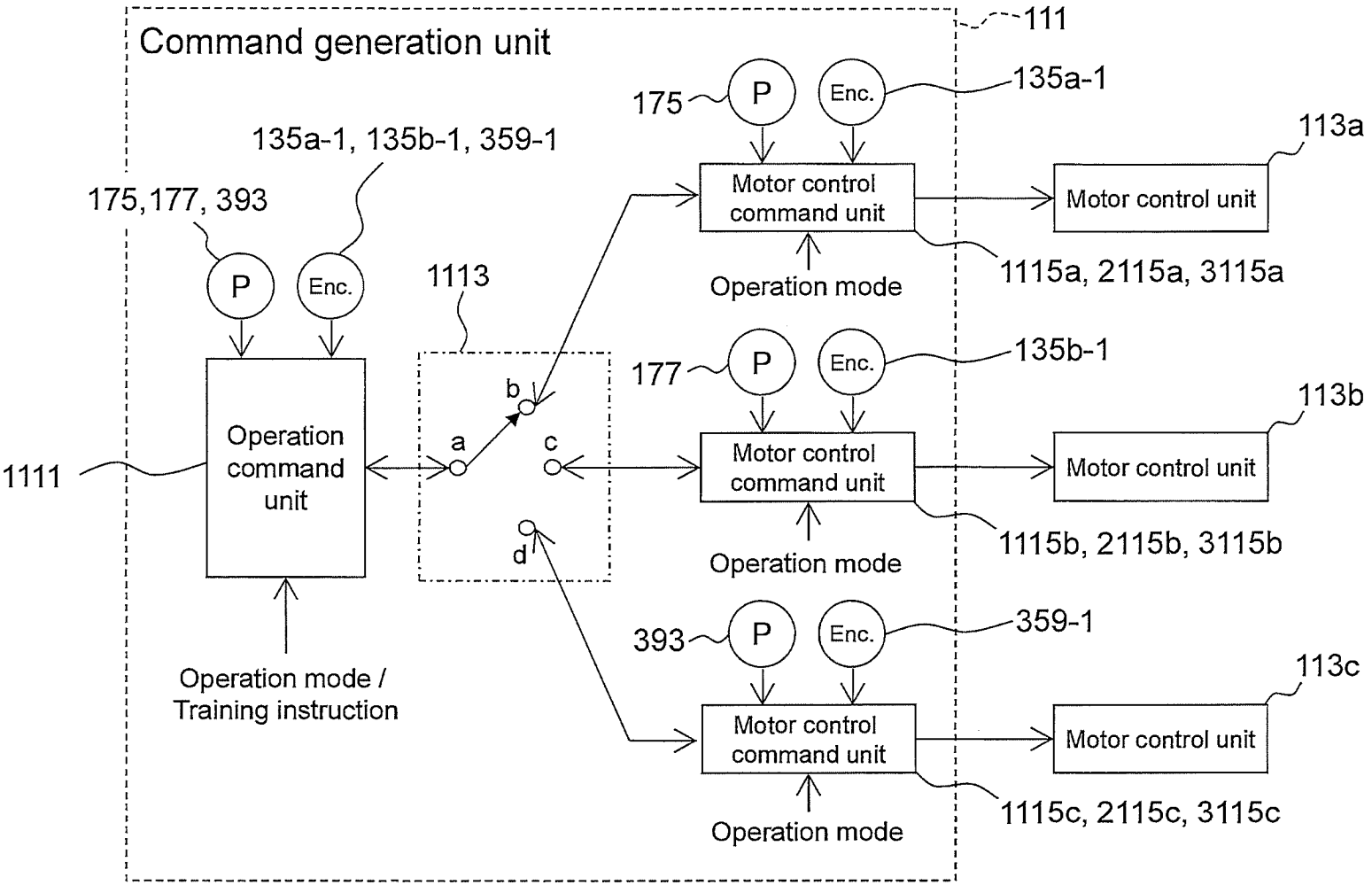
FIG. 6 is a diagram illustrating a structure of a command generation unit.

II. Structure of command generation unit Next, details of the structure of the command generation unit 111 are described with reference to FIG. 6. The command generation unit 111 includes an operation command unit 1111, a transmission switching unit 1113, and three motor control command units 1115*a*, 1115*b*, and 1115*c*.

The operation command unit 1111 can send and receive signals to and from the training instruction unit 5. Thus, the operation command unit 1111 receives the first operation mode execution instruction or the second operation mode execution instruction from the training instruction unit 5. In addition, the operation command unit 1111 receives the training instruction designated in the training program from the training instruction unit 5.

When receiving the second operation mode execution instruction (when executing the second operation mode), the operation command unit 1111 generates the operation command representing the operation of the operation rod 3 based on the training instruction designated in the training program.

In addition, the operation command unit 1111 is connected to the Y-axis direction force detection unit 175, the X-axis direction force detection unit 177, and the expansion detection unit 393 in a manner capable of transmitting and receiving signals. Thus, the operation command unit 1111 can receive the force component signals of the operation rod 3 in the directions of degree of freedom (the X-axis direction, the Y-axis direction, and the length direction), as necessary. As a result, when executing the second operation mode, the operation command unit 1111 can receive the force component signals more quickly in the case where the force component signals are necessary (as the force sense trigger or the like, for example).

Further, the operation command unit 1111 is connected to the first rotation information output sensor 135*a*-1, the second rotation information output sensor 135*b*-1, and the third rotation information output sensor 359-1 in a manner capable of transmitting and receiving signals. In this way, the output values of the rotation information output sensors are sent to the operation command unit 1111, and on the basis of the output, the position information of the operation rod 3 in the directions of degree of freedom (the X-axis direction, the Y-axis direction, and the length direction) can be received as the motor control commands.

It should be noted that, as a variation, the operation command unit 1111 may not be connected to the rotation information output sensors. In this case, the position information in the directions of degree of freedom is received from the rotation information output sensors connected to the motor control command units, respectively.

In addition, the operation command unit 1111 transmits position information in the directions of degree of freedom of other axes, which are obtained directly from the sensors or obtained via the motor control command unit, to the motor control command units. For example, position information of the second rotation information output sensor 135*b*-1 and the third rotation information output sensor 359-1, which are not connected to the motor control command unit 1115*a*, are transmitted to the motor control command unit 1115*a*.

Further, the operation command unit 1111 is connected to an input "a" of the transmission switching unit 1113 in a manner capable of transmitting and receiving signals. In this way, when executing the second operation mode, the operation command unit 1111 can transmit the calculated operation command to the transmission switching unit 1113. As a result, the operation command calculated by the operation command unit 1111 is transmitted to each of the three motor control command units 1115*a*, 1115*b*, and 1115*c* via the transmission switching unit 1113.

On the other hand, when executing the first operation mode, the operation command unit 1111 may output the position information in the directions of degree of freedom of the operation rod 3 (three directions of degree of freedom including the X-axis direction, the Y-axis direction, and the length direction of the operation rod 3 in this embodiment), as necessary. In this way, each of the three motor control command units 1115*a*, 1115*b*, and 1115*c* can refer to the position information in the three directions of degree of freedom.

In this embodiment, the transmission switching unit 1113 has one input "a" and three outputs b, c, and d. The transmission switching unit 1113 selects one of the outputs b, c, and d to be connected to the input "a" so as to connect the selected output and the input "a" at a predetermined period. In this way, the transmission switching unit 1113 can transmit the signal input to the input "a" to one of the three motor control command units 1115*a*, 1115*b*, and 1115*c*, in order at a predetermined period.

The input "a" of the transmission switching unit 1113 is connected to the operation command unit 1111 in a manner capable of transmitting and receiving signals. Thus, when executing the second operation mode, the transmission switching unit 1113 transmits the operation command including information such as a target position and a moving speed of the operation rod 3 calculated by the operation command unit 1111 to one of the three motor control command units 1115*a*, 1115*b*, and 1115*c*, in order at a predetermined period.

On the other hand, when executing the first operation mode, if the operation command unit 1111 outputs the position information in the three directions of degree of freedom of the operation rod 3, the transmission switching unit 1113 transmits the position information in the three directions of degree of freedom to one of the three motor control command units 1115*a*, 1115*b*, and 1115*c* at a predetermined period.

The transmission switching unit 1113 may be realized as hardware by a switch that has one input "a" and three outputs b, c, and d, so as to connect the input "a" to one selected output based on a signal from the operation command unit 1111 or the like.

Alternatively, it is possible to assign an individual communication address (for example, an individual ID, an IP address, a port number, or the like) to each of the three motor control command units 1115*a*, 1115*b*, and 1115*c* in advance, so that the transmission switching unit 1113 can transmit the signal from the operation command unit 1111 to a communication address designated by the operation command unit 1111 or the like. In this case, the transmission switching unit 1113 may be realized as a program for controlling a communication interface provided to a microcomputer system of the control unit 11 so as to be connected to the three motor control command units. Further, in this case, the operation command unit 1111 may transmit a communication packet, which includes a signal to be transmitted and a communication address to be a destination of the signal to be transmitted, to the transmission switching unit 1113 at a predetermined period.

The three motor control command units 1115*a*, 1115*b*, and 1115*c* are respectively connected to the outputs b, c, and d of the transmission switching unit 1113 in a manner capable of transmitting and receiving signals. Thus, each of the three motor control command units 1115*a*, 1115*b*, and 1115*c* can receive the operation command (when executing the second operation mode) and/or the position information and the force component signals in the three directions of degree of freedom (as necessary), from the operation command unit 1111 via the transmission switching unit 1113 at a predetermined period.

By receiving the operation command and/or the position information in the three directions of degree of freedom and the force component signals, from the operation command unit 1111, the three motor control command units 1115*a*, 1115*b*, and 1115*c* can calculate the second motor control command for controlling the respective motors 135*a*, 135*b*, and 359 based on the operation command.

Specifically, the motor control command unit 1115*a* calculates the second motor control command for the Y-axis direction tilt motor 135*a* that is controlled by the motor control unit 113*a*. The motor control command unit 1115*b* calculates the second motor control command for the X-axis direction tilt motor 135*b* that is controlled by the motor control unit 113*b*. The motor control command unit 1115*c* calculates the second motor control command for the telescoping motor 359 that is controlled by the motor control unit 113*c*.

It should be noted that, when the control unit 11 is constituted of a plurality of microcomputer systems, each of the three motor control command units 1115*a*, 1115*b*, and 1115*c* can be constituted of a separate microcomputer system. In other words, each of the three motor control command units 1115*a*, 1115*b*, and 1115*c* may include a CPU, a storage device such as a RAM and a ROM, an electric signal conversion interface (electric signal conversion circuit), and a communication interface (communication circuit). In this case, functions of the three motor control command units 1115*a*, 1115*b*, and 1115*c* can be distributed into a plurality of microcomputer systems.

In addition, as described above, when each of the three motor control command units 1115*a*, 1115*b*, and 1115*c* is constituted of each microcomputer system, the operation command unit 1111 can also be an individual microcomputer system including a CPU, a storage device such as a RAM and a ROM, and a communication interface (communication circuit).

In addition, each of the three motor control command units 1115*a*, 1115*b*, and 1115*c* is connected to the corresponding force detection unit in a manner capable of transmitting and receiving signals. Specifically, the motor control command unit 1115*a* is connected to the Y-axis direction force detection unit 175 in a manner capable of transmitting and receiving signals. The motor control command unit 1115*b* is connected to the X-axis direction force detection unit 177 in a manner capable of transmitting and receiving signals. The motor control command unit 1115*c* is connected to the expansion detection unit 393 in a manner capable of transmitting and receiving signals.

In this way, when executing the first operation mode, the three motor control command units 1115*a*, 1115*b*, and 1115*c* can calculate the first motor control command for controlling the corresponding motors 135*a*, 135*b*, and 359 based on the force component signals input from the corresponding force detection units.

Specifically, the motor control command unit 1115*a* calculates the first motor control command for controlling the Y-axis direction tilt motor 135*a* that is controlled by the motor control unit 113*a*, on the basis of the Y-axis direction force component signal output from the Y-axis direction force detection unit 175.

The motor control command unit 1115*b* calculates the first motor control command for controlling the X-axis direction tilt motor 135*b* that is controlled by the motor control unit 113*b*, on the basis of the X-axis direction force component signal output from the X-axis direction force detection unit 177.

The motor control command unit 1115*c* calculates the first motor control command for controlling the telescoping motor 359 that is controlled by the motor control unit 113*c*, on the basis of the length direction force component signal output from the expansion detection unit 393.

In addition, as described above, because the three motor control command units 1115*a*, 1115*b*, and 1115*c* are respectively connected to the Y-axis direction force detection unit 175, the X-axis direction force detection unit 177, and the expansion detection unit 393, the three motor control command units 1115*a*, 1115*b*, and 1115*c* can obtain the corresponding force component signals with a higher frequency than obtaining via the transmission switching unit 1113. As a result, even if the force applied to the operation rod 3 varies, the three motor control command units 1115*a*, 1115*b*, and 1115*c* can calculate the first motor control command in accordance with the force variation.

Further, as a result, even if the force applied to the operation rod 3 varies, the operation rod 3 can be appropriately controlled to follow the variation.

Further, the three motor control command units 1115*a*, 1115*b*, and 1115*c* are respectively connected to the first rotation information output sensor 135*a*-1, the second rotation information output sensor 135*b*-1, and the third rotation information output sensor 359-1 in a manner capable of transmitting and receiving signals.

In this way, the three motor control command units 1115*a*, 1115*b*, and 1115*c* can calculate the corresponding first motor control commands based on the Y-axis direction position information (tilt angle), the X-axis direction position information (tilt angle), and the length direction position information of the operation rod 3, respectively.

As a result, the training device 100 can appropriately control the operation rod 3 while monitoring the position of the operation rod 3 (operation position).

In addition, each of the three motor control command units 1115*a*, 1115*b*, and 1115*c* is connected to the training instruction unit 5 in a manner capable of transmitting and receiving signals. In this way, each of the three motor control command units 1115*a*, 1115*b*, and 1115*c* can receive from the training instruction unit 5 either the first operation mode execution instruction or the second operation mode execution instruction. It should be noted that the three motor control command units may receive from the operation command unit 1111 the first operation mode execution instruction or the second operation mode execution instruction.

When each of the three motor control command units 1115*a*, 1115*b*, and 1115*c* receives the first operation mode execution instruction (when executing the first operation mode), it outputs the first motor control command as the motor control command to the corresponding one of the motor control units 113*a*, 113*b*, and 113*c*. When it receives the second operation mode execution instruction (when executing the second operation mode), it outputs the second motor control command.

In this way, the training device 100 can select the appropriate motor control command in accordance with a plurality of operation modes. As a result, the training device 100 can appropriately operate the operation rod 3 in accordance with the operation mode.

III. Structure of Motor Control Command Unit

Figure 7:
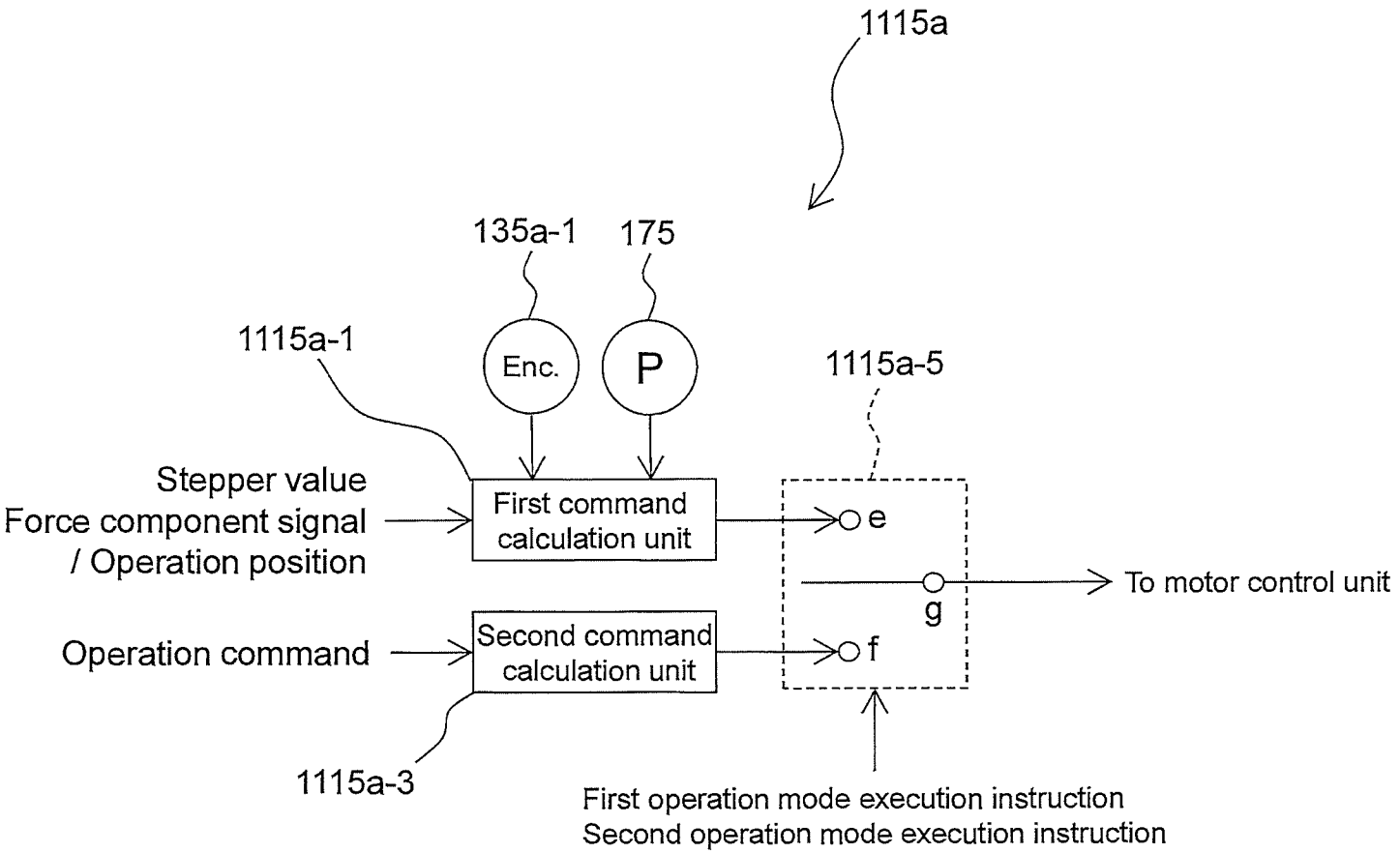
FIG. 7 is a diagram illustrating a structure of a motor control command unit of the training device according to a first embodiment.

Next, the structures of the motor control command units 1115*a*, 1115*b*, and 1115*c* of the training device according to the first embodiment are described with reference to FIG. 7.

In the following description, the motor control command unit 1115*a* is exemplified for describing the structures of the motor control command units 1115*a*, 1115*b*, and 1115*c*. It is because the structures of the other motor control command units 1115*b* and 1115*c* are the same as the structure of the motor control command unit 1115*a*.

The motor control command unit 1115*a* includes a first command calculation unit 1115*a*-1, a second command calculation unit 1115*a*-3, and a control command switching unit 1115*a*-5. It should be noted that the functions of the first command calculation unit 1115*a*-1, the second command calculation unit 1115*a*-3, and the control command switching unit 1115*a*-5 described below can be realized as a program to be executed by the motor control command unit.

The first command calculation unit 1115*a*-1 is connected to the corresponding force detection unit (the Y-axis direction force detection unit 175 in the case of the motor control command unit 1115*a*) in a manner capable of transmitting and receiving signals. Therefore, the first command calculation unit 1115*a*-1 can calculate the first motor control command based on the force component signal (Y-axis direction force component signal) output from the corresponding force detection unit (Y-axis direction force detection unit 175). The first motor control command is a motor control command for controlling the corresponding motor (motor 135*a*) based on the detected force component (Y-axis direction force component signal).

Since the first command calculation unit 1115*a*-1 is connected to the corresponding force detection unit (Y-axis direction force detection unit), the first command calculation unit 1115*a*-1 can obtain the corresponding force component signal (Y-axis direction force component signal) with a higher frequency. As a result, even if the force applied to the operation rod 3 varies, the first command calculation unit 1115*a*-1 can calculate the first motor control command in accordance with the force variation. Further, as a result, the operation rod 3 can be appropriately controlled to follow the variation of the force applied to the operation rod 3.

In addition, the first command calculation unit 1115*a*-1 is connected to the corresponding rotation information output sensor (first rotation information output sensor 135*a*-1) in a manner capable of transmitting and receiving signals. In this way, the first command calculation unit 1115*a*-1 can calculate the first motor control command based on the operation position (operation position (tilt angle) in the Y-axis direction) detected by the corresponding rotation information output sensor (first rotation information output sensor 135*a*-1).

As a result, the first command calculation unit 1115*a*-1 can calculate the first motor control command that can appropriately control the motor 135*a* (operation rod 3), while monitoring the position of the operation rod 3 (operation position (tilt angle)).

Further, the first command calculation unit 1115*a*-1 receives a set value of the stepper value from the operation command unit 1111 at a predetermined period. The stepper value is a value for determining the force applied to the operation rod 3 that maximizes the operation speed of the operation rod 3. In other words, the stepper value is a value for determining response sensitivity of the operation rod 3 with respect to the force applied to the operation rod 3.

In this way, when executing the first operation mode in which the operation rod 3 is operated based on the force applied to the operation rod 3, the first command calculation unit 1115*a*-1 can calculate the first motor control command based on the response sensitivity requested by the patient or the like. As a result, when executing the first operation mode, the operability of the operation rod 3 can be adjusted.

In addition, if the operation command unit 1111 outputs the stepper value described above, the management of the stepper value can be centralized by the operation command unit 1111.

It should be noted that the stepper value may be changeable during the execution of the first operation mode. In other words, if the set value of the stepper value is changed by the instruction unit 5 or the like in the training during the execution of the first operation mode, the operation command unit 1111 notifies the first command calculation unit 1115*a*-1 of the updated stepper value.

In this way, during the execution of the first operation mode, the operability of the operation rod 3 can be appropriately adjusted.

Further, the first command calculation unit 1115*a*-1 may receive the force component signals and/or the operation positions in other directions of degree of freedom (the X-axis direction and the length direction of the operation rod 3 in the case of the first command calculation unit 1115*a*-1), from the operation command unit 1111, at a predetermined period as necessary. In this way, the first command calculation unit 1115*a*-1 can also refer to information in other directions of degree of freedom.

In addition, the first command calculation unit 1115*a*-1 is connected to one of two inputs (input e) of the control command switching unit 1115*a*-5 in a manner capable of transmitting and receiving signals. In this way, the first command calculation unit 1115*a*-1 can output the calculated first motor control command to the input e of the control command switching unit 1115*a*-5.

The second command calculation unit 1115*a*-3 can receive the operation command calculated by the operation command unit 1111, from the operation command unit 1111, at a predetermined period. In this way, the second command calculation unit 1115*a*-3 can calculate the second motor control command based on the received operation command. In other words, when executing the second operation mode, the second command calculation unit 1115*a*-3 can calculate the second motor control command for controlling the corresponding motor (motor 135*a*), on the basis of the training instruction designated in the training program.

In addition, the second command calculation unit 1115*a*-3 is connected to an input (input f) other than the input connected to the first command calculation unit 1115*a*-1, out of the two inputs of the control command switching unit 1115*a*-5, in a manner capable of transmitting and receiving signals. In this way, the second command calculation unit 1115*a*-3 can output the calculated second motor control command to the input f of the control command switching unit 1115*a*-5.

The control command switching unit 1115*a*-5 has two inputs e and f and one output g. In addition, the control command switching unit 1115*a*-5 receives the first operation mode execution instruction or the second operation mode execution instruction from the training instruction unit 5. In this way, when receiving the first operation mode execution instruction (namely when executing the first operation mode), the control command switching unit 1115*a*-5 can connect the input e to the output g. On the other hand, when receiving the second operation mode execution instruction (namely when executing the second operation mode), it can connect the input f to the output g.

As described above, the input e of the control command switching unit 1115*a*-5 is connected to the first command calculation unit 1115*a*-1, and the input f is connected to the second command calculation unit 1115*a*-3. In addition, the output g is connected to the corresponding motor control unit (motor control unit 113*a*) in a manner capable of transmitting and receiving signals.

Therefore, when executing the first operation mode, the control command switching unit 1115*a*-5 can output to the corresponding motor control unit 113*a* the motor control command that is the first motor control command output from the first command calculation unit 1115*a*-1. On the other hand, when executing the second operation mode, the control command switching unit 1115*a*-5 can output to the corresponding motor control unit 113*a* the motor control command that is the second motor control command output from the second command calculation unit 1115*a*-3.

In this way, the control command switching unit 1115*a*-5 can select an appropriate motor control command in accordance with the plurality of operation modes and output the same to the corresponding motor control unit 113*a*. As a result, the corresponding motor 135*a* is appropriately controlled based on the appropriate motor control command. In this way, the training device 100 can appropriately operate the operation rod 3 in accordance with the operation mode.

(5) Operation of Training Device

I. Basic Operation of Training Device

Figure 8A:
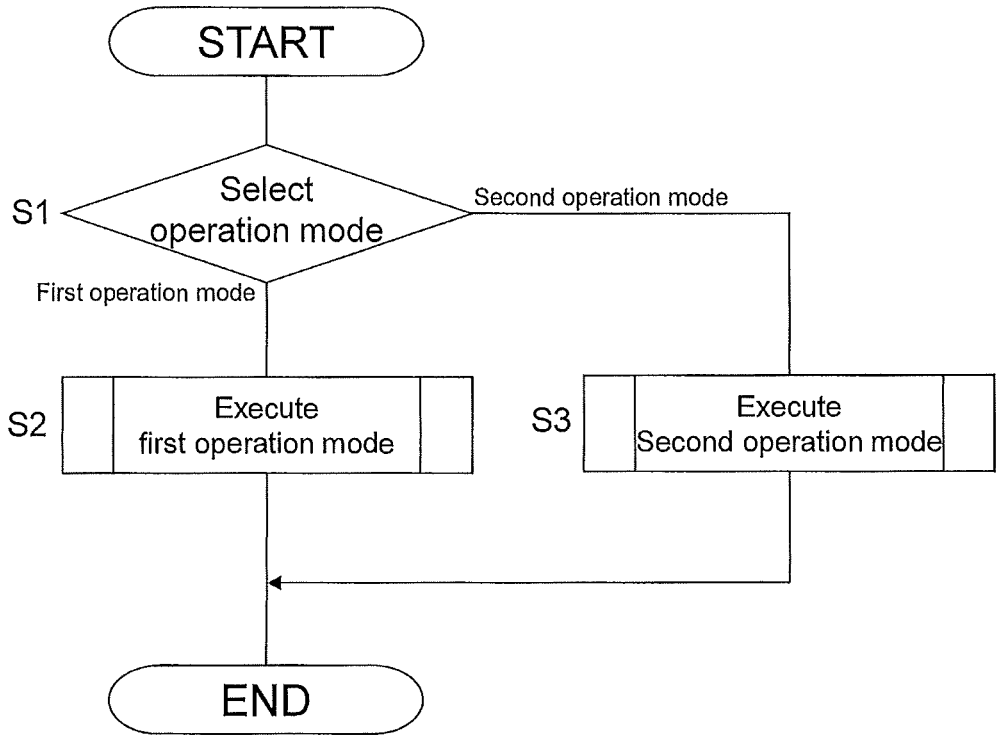
FIG. 8A is a flowchart illustrating a basic operation of the training device.

Next, a basic operation of the training device 100 according to the first embodiment is described with reference to FIG. 8A. FIG. 8A is a flowchart illustrating a basic operation of the training device. In the following description of the operation, when describing operations concerning the motor control command units 1115*a*, 1115*b*, and 1115*c*, the operation of the motor control command unit 1115*a* among the plurality of motor control command units 1115*a*, 1115*b*, and 1115*c* is exemplified for description. It is because the other motor control command units 1115*b* and 1115*c* also performs the same operation.

When the training device 100 starts operating, the training instruction unit 5 first selects whether to operate the operation rod 3 in the first operation mode or to operate the operation rod 3 in the second operation mode (Step S1).

Specifically, when the training instruction unit 5 selects the Free Mode as the training program, the first operation mode is selected as the operation mode, in which the operation rod 3 is operated based on the force applied to the operation rod 3.

On the other hand, when the training instruction unit 5 selects a mode other than the Free Mode as the training program, the second operation mode is selected as the operation mode, in which the operation rod 3 is operated based on the training instruction designated by the training program.

After the training instruction unit 5 selects the operation mode, the training instruction unit 5 notifies the control unit 11 whether to operate the operation rod 3 in the first operation mode or to operate in the second operation mode. Specifically, when selecting the first operation mode as the operation mode, the training instruction unit 5 transmits the first operation mode execution instruction to the control unit 11. On the other hand, when selecting the second operation mode as the operation mode, the training instruction unit 5 transmits the second operation mode execution instruction to the control unit 11.

When the control unit 11 receives the first operation mode execution instruction from the training instruction unit 5 (in the case of the "first operation mode" in Step S1), the control command switching unit 1115*a*-5 of the motor control command unit 1115*a* connects the input e to the output g. In this way, the motor control command unit 1115*a* outputs the first motor control command calculated by the first command calculation unit 1115*a*-1, as the motor control command for the corresponding motor 135*a*.

As a result, the corresponding motor 135*a* is controlled by the motor control unit 113*a*, on the basis of the first motor control command based on the force applied to the operation rod 3. In other words, the operation rod 3 operates based on the force applied to the operation rod 3 (namely the first operation mode is executed) (Step S2).

On the other hand, when the control unit 11 receives the second operation mode execution instruction from the training instruction unit 5 (in the case of "second operation mode" in Step S1), the control command switching unit 1115*a*-5 of the motor control command unit 1115*a* connects the input f to the output g. In this way, the motor control command unit 1115*a* outputs the second motor control command calculated by the second command calculation unit 1115*a*-3, as the motor control command for the corresponding motor 135*a*.

As a result, the corresponding motor 135*a* is controlled by the motor control unit 113*a*, on the basis of the second motor control command based on the operation command output from the operation command unit 1111. In other words, the operation rod 3 operates based on the training instruction designated by the training program (namely the second operation mode is executed) (Step S3).

In this way, an appropriate operation mode is selected in accordance with the training program, and the motor control command (the first motor control command or the second motor control command) is selected for controlling the operation rod 3 (motors 135*a*, 135*b*, and 359) based on the selected operation mode (the first operation mode or the second operation mode). Thus, the training device 100 can appropriately operate the operation rod 3 in accordance with the training program.

II. Operation of Training Device when Executing First Operation Mode

Figure 8B:
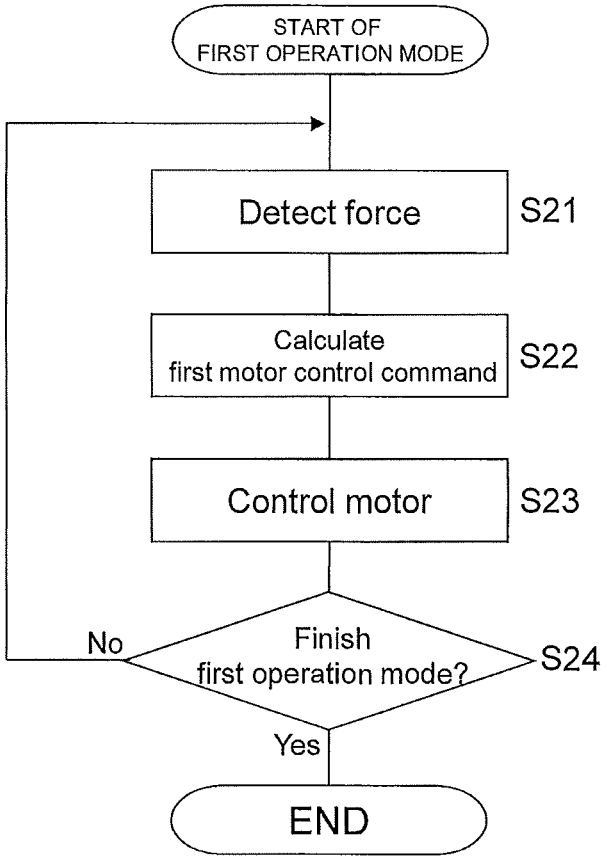
FIG. 8B is a flowchart illustrating an operation of the training device when executing a first operation mode of the training device according to the first embodiment.

Next, the details of the operation of the training device 100 when executing the first operation mode in Step S2 are described with reference to FIG. 8B. FIG. 8B is a flowchart illustrating the operation of the training device when executing the first operation mode of the training device according to the first embodiment.

When the first operation mode starts, the first command calculation unit 1115*a*-1 first receives the Y-axis direction force component signal output from the Y-axis direction force detection unit 175, which is connected to the first command calculation unit 1115*a*-1 (Step S21). In this way, the first command calculation unit 1115*a*-1 can obtain the force component in the Y-axis direction of the force applied to the operation rod 3 as the force component signal.

In addition, in Step S21 described above, the first command calculation unit 1115*a*-1 obtains the operation position (tilt angle) of the operation rod 3 (in the Y-axis direction) from the corresponding rotation information output sensor (first rotation information output sensor 135*a*-1). In this way, the first command calculation unit 1115*a*-1 can calculate the first motor control command while monitoring the operation position (tilt angle) of the operation rod 3.

Further, the first command calculation unit 1115*a*-1 receives the operation position and/or force component signal in other directions of degree of freedom (the X-axis direction and/or the length direction of the operation rod 3) from the operation command unit 1111, as necessary. In this way, the first command calculation unit 1115*a*-1 can calculate the first motor control command while referring to information in other directions of degree of freedom, too.

Specifically, for example, the first command calculation unit 1115*a*-1 monitors whether or not the operation position of the operation rod 3 is within the operation range of the operation rod 3, so as to perform a predetermined process.

Next, the first command calculation unit 1115*a*-1 calculates the first motor control command for controlling the corresponding motor 135*a* based on the obtained Y-axis direction force component signal (Step S22).

Specifically, in accordance with the signal value of the obtained Y-axis direction force component signal (namely magnitude of the force component in the Y-axis direction), the first motor control command is calculated, which determines the operation speed of the operation rod 3 (namely rotation speed of the motor 135*a*).

For example, the first command calculation unit 1115*a*-1 calculates the first motor control command that increases the operation speed of the operation rod 3 (rotation speed of the motor 135*a*) with respect to an increase in the Y-axis direction force component signal (magnitude of the force component).

After calculating the first motor control command in Step S22, the first command calculation unit 1115*a*-1 outputs the calculated first motor control command to the control command switching unit 1115*a*-5.

When executing the first operation mode, the control command switching unit 1115*a*-5 connects the input e to the output g, and hence the first motor control command output from the first command calculation unit 1115*a*-1 is output as the motor control command to the corresponding motor control unit 113*a*. As a result, the corresponding motor 135*a* is controlled based on the first motor control command (Step S23). In other words, the corresponding motor 135*a* is controlled based on the force component in the Y-axis direction of the force applied to the operation rod 3.

Next, the first command calculation unit 1115*a*-1 monitors whether or not the first operation mode is finished (Step S24). Specifically, when the training instruction unit 5 instructs to stop executing the Free Mode, for example, the first command calculation unit 1115*a*-1 can monitor whether or not the first operation mode is finished.

If it is determined that the first operation mode is finished (in the case of "Yes" in Step S24), the first command calculation unit 1115*a*-1 stops the detection of the force and stops the calculation of the first motor control command (end of the first operation mode).

On the other hand, if it is determined that the first operation mode is being executed (continued) (in the case of "No" in Step S24), the first command calculation unit 1115*a*-1 returns to Step S21 and continues the detection of the force and the calculation of the first motor control command.

As described above, during the execution of the first operation mode, the first command calculation unit 1115*a*-1 always receives the force component signal output from the corresponding force detection unit (Y-axis direction force detection unit 175), and it calculates the first motor control command based on the received force component signals.

In addition, as described above, the first command calculation unit 1115*a*-1 is directly connected to the corresponding force detection unit (Y-axis direction force detection unit 175).

In this way, the first command calculation unit 1115*a*-1 can obtain the corresponding force component signal (Y-axis direction force component signal) with a higher frequency than frequency of receiving the operation command described later. As a result, the first command calculation unit 1115*a*-1 can appropriately obtain the force variation even if the force applied to the operation rod 3 varies.

Because the first command calculation unit 1115*a*-1 appropriately obtains the variation of the force (force component signal), even if the force applied to the operation rod 3 varies, the first command calculation unit 1115*a*-1 can calculate the first motor control command in accordance with to the force variation. As a result, the operation rod 3 can be appropriately controlled to follow the variation of the force applied to the operation rod 3.

III. Operation of Training Device when Executing Second Operation Mode

Figure 8C:
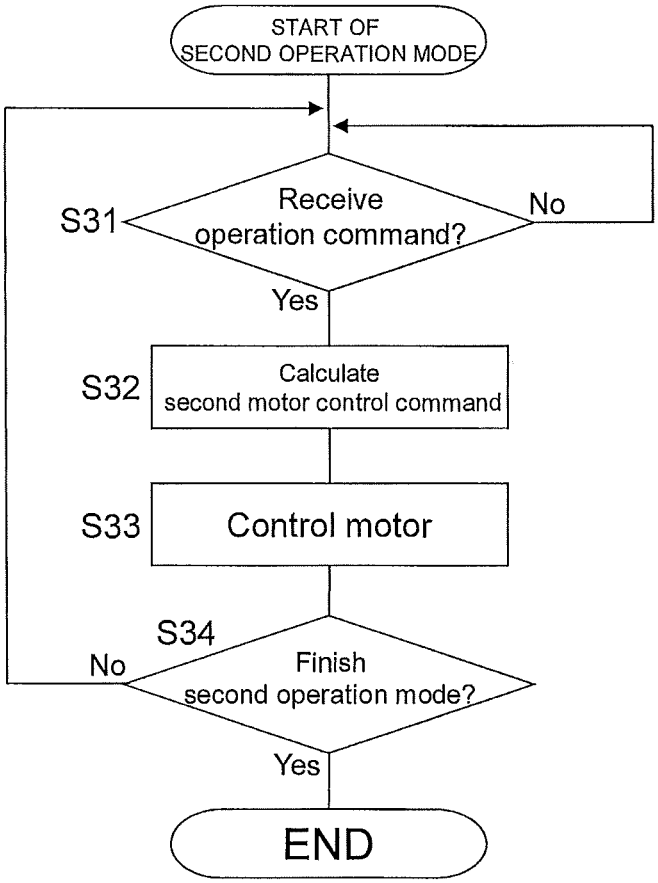
FIG. 8C is a flowchart illustrating an operation of the training device when executing a second operation mode.

Next, the details of the operation of the training device 100 when executing the second operation mode in Step S3 are described with reference to FIG. 8C. FIG. 8C is a flowchart illustrating the operation of the training device when executing the second operation mode of the training device according to the first embodiment.

When the training device 100 starts the second operation mode, the training instruction unit 5 first transmits to the operation command unit 1111 the training instruction corresponding to the training program described above. It should be noted that the training instruction unit 5 may transmit the training instruction to the operation command unit 1111 at one time or may transmit the same in several times. In addition, it is possible to determine whether to transmit the training instruction at one time or to transmit the same in several times, in accordance with the training program or the operation mode.

When receiving the training instruction from the training instruction unit 5, the operation command unit 1111 calculates the operation command of the operation rod 3 based on the received training instruction. Specifically, for example, the operation command unit 1111 calculates the operation command that instructs the operation speed of the operation rod 3 (rotation speed of the motor 135*a*), on the basis of the training instruction.

Next, the operation command unit 1111 transmits the calculated operation command to each of the three motor control command units 1115*a*, 1115*b*, and 1115*c* via the transmission switching unit 1113.

When the operation command unit 1111 transmits the operation command to each of the motor control command units 1115*a*, 1115*b*, and 1115*c*, the transmission switching unit 1113 selects one of the outputs b, c, and d to be connected to the input "a" one by one, and it connects the selected one of the outputs b, c, and d to the input "a". Therefore, a specific one of the outputs b, c, and d is connected to the input "a" at a predetermined period.

As a result, the operation command unit 1111 is seen as outputting the operation command to one of the motor control command units 1115*a*, 1115*b*, and 1115*c* at a predetermined period.

While the operation command unit 1111 outputs the operation command, the motor control command unit 1115*a* monitors whether or not the operation command is received (Step S31).

If the motor control command unit 1115*a* has not received the operation command (in the case of "No" in Step S31), the motor control command unit 1115*a* wait to receive the operation command.

On the other hand, if the motor control command unit 1115*a* has received the operation command (in the case of "Yes" in Step S31), the second command calculation unit 1115*a*-3 of the motor control command unit 1115*a* receives the operation command, and it calculates the second motor control command based on the received operation command (Step S32). In this way, the second command calculation unit 1115*a*-3 calculates the second motor control command every predetermined period for receiving the operation command.

The second motor control command calculated by the second command calculation unit 1115*a*-3 is, specifically for example, a motor control command to follow the operation speed of the operation rod 3 (rotation speed of the motor 135*a*) instructed in the operation command.

After calculating the second motor control command in Step S32, the second command calculation unit 1115*a*-3 outputs the calculated second motor control command to the control command switching unit 1115*a*-5.

When executing the second operation mode, the control command switching unit 1115*a*-5 connects the input f to the output g, and hence the second motor control command output from the second command calculation unit 1115*a*-3 is output as the motor control command to the corresponding motor control unit 113*a*. As a result, the corresponding motor 135*a* is controlled based on the second motor control command (Step S33). In other words, the corresponding motor 135*a* is controlled based on the training instruction designated in the training program.

Next, the second command calculation unit 1115*a*-3 monitors whether or not the second operation mode is finished (Step S34). Specifically, for example, when the training instruction unit 5 instructs to stop the execution of the training program for executing the second operation mode, the second command calculation unit 1115*a*-3 can monitors whether or not the second operation mode is finished.

If the second command calculation unit 1115*a*-3 determines that the second operation mode is finished (in the case of "Yes" in Step S34), the second command calculation unit 1115*a*-3 stops receiving the operation command and stops calculating the second motor control command (end of the second operation mode).

On the other hand, if the second command calculation unit 1115*a*-3 determines that the second operation mode is being executed (continued) (in the case of "No" in Step S34), the second command calculation unit 1115*a*-3 returns to Step S31, so as to continue reception of the operation command and calculation of the second motor control command.

As described above, during the execution of the second operation mode, the second command calculation unit 1115*a*-3 calculates the second motor control command based on the received operation command every time when receiving the operation command (namely every predetermined period). As described above, even if the frequency of calculating the second motor control command is substantially equal to the frequency of receiving the operation command (every predetermined period), the operation rod 3 can sufficiently operates as instructed by the operation command.

It is because the operation command (training instruction) is a command having characteristics to move along a predetermined route at a predetermined speed, while the force applied to the operation rod 3 may vary at random. Therefore, even if the second motor control command based on this operation command is calculated at a frequency of an approximately predetermined period (for example, approximately a few tens of milliseconds), the calculated second motor control command can sufficiently reproduce the operation command (training instruction).

On the other hand, each of the first command calculation units of the plurality of motor control command units 1115*a*, 1115*b*, and 1115*c* calculates the first motor control command at a high frequency (distributed control process) based on the force that may vary at random. In this way, the response speed of the operation rod 3 when executing the first operation mode can be improved.

In addition, since the operation rod 3 starts operating by the force sense trigger depending on the operation mode when executing the second operation mode, the response speed of the operation rod 3 to the force sense trigger can be improved more if the operation command unit 1111 calculates the second motor control command so as to transmit the same to the motor control command unit.

Further, since the frequency of transmitting the operation command calculated by the operation command unit 1111 is approximately equal to every predetermined period, it is possible to use an inexpensive control unit 11 and to reduce communication noise in the transmission switching unit 1113 while transmitting the operation command to each of the motor control command units 1115*a*, 1115*b*, and 1115*c*.

(6) Second Embodiment

I. Correction of Force Component Signal

In the training device 100 according to the first embodiment described above, the motor control command units 1115*a*, 1115*b*, and 1115*c* (the first command calculation units) directly receive the force component signals from the corresponding force detection units (the Y-axis direction force detection unit 175, the X-axis direction force detection unit 177, and the expansion detection unit 393), respectively.

However, this is not a limitation. The training device 200 according to the second embodiment corrects the signal value of the force component signal output from the force detection unit. The training device 200 according to the second embodiment is described below.

First, the correction of the force component signals is described in the case of using a potentiometer as the force detection unit as described above in the description of the training device 100 according to the first embodiment. In the measurement of the force component using a potentiometer, a constant voltage source or the like is connected between a pair of reference electrodes of the potentiometer so that a voltage (or a constant current) is applied between the reference electrodes, and a measurement voltage value between one resistance measurement electrode and one of the pair of reference electrodes is measured, so that the tilt angle $\theta_F$ by the force (namely the force) is measured.

However, since the magnitude of the tilt angle $\theta_F$ by the force is very small, the voltage variation obtained due to the variation of the tilt angle $\theta_F$ is also very small. Therefore, the training device 100 amplifies the obtained voltage variation and uses the amplified voltage variation as the force component signal.

In this case, the signal value when the tilt angle $\theta_F$ by the force is zero (namely the force is zero) or the variation of the measurement voltage with respect to the variation of the tilt angle $\theta_F$ may change due to characteristics change of the potentiometer (in particular, resistance). In other words, when the same magnitude of force is applied to the operation rod 3, the obtained signal value of the force component signal may be different.

In addition, even if the potentiometers having the identical characteristics are used, the signal value of the force component signal with respect to the same force may differ among the motor control command units 1115*a*, 1115*b*, and 1115*c*, because of the difference of characteristics due to an individual difference of the biasing members 179 and 391 or an individual difference of the potentiometer.

Therefore, the training device 200 according to the second embodiment corrects a "shift" in the force component signal so that the force component signal correctly corresponds to the force applied to the operation rod 3. In addition, as described above, even if the potentiometers having the identical characteristics are used, the signal value of the force component signal with respect to the same force may differ among the motor control command units 1115*a*, 1115*b*, and 1115*c*. Therefore, the correction of the force component signal is performed separately in the motor control command units 1115*a*, 1115*b*, and 1115*c*.

II. Structure of Training Device According to Second Embodiment

Figure 9:
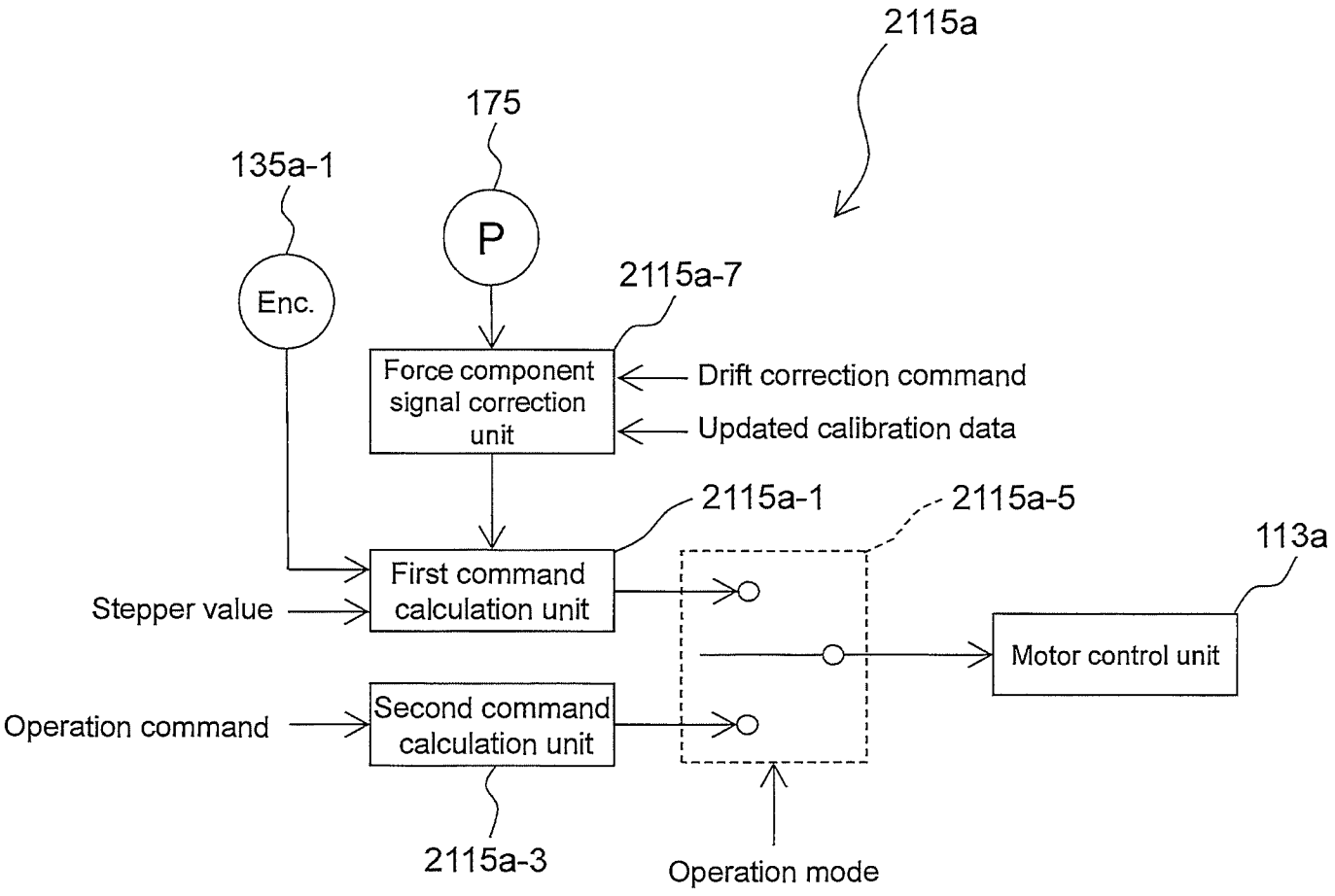
FIG. 9 is a diagram illustrating a structure of a motor control command unit of the training device according to a second embodiment.

Next, the structures of three motor control command units 2115*a*, 2115*b*, and 2115*c* of the training device 200 according to the second embodiment, which correct the force component signals, are described with reference to FIG. 9.

The training device 200 according to the second embodiment has substantially the same structure as the training device 100 according to the first embodiment, except that each of the three motor control command units further includes a force component signal correction unit. Therefore, in the following description, the descriptions of the parts other than the motor control command unit are omitted.

In addition, in the following description, the structure of the motor control command unit 2115*a* is exemplified for description. It is because the other motor control command units 2115*b* and 2115*c* have the same structure as the motor control command unit 2115*a*.

It should be noted that the functions of the elements of the motor control command units 2115*a*, 2115*b*, and 2115*c* described below may be realized as a microcomputer system constituting the control unit 11 or as a program executed by the microcomputer system constituting the motor control command units 2115*a*, 2115*b*, and 2115*c*.

The motor control command unit 2115*a* of the training device 200 according to the second embodiment includes a first command calculation unit 2115*a*-1, a second command calculation unit 2115*a*-3, a control command switching unit 2115*a*-5, and a force component signal correction unit 2115*a*-7.

It should be noted that the second command calculation unit 2115*a*-3 and the control command switching unit

2115*a*-5 have the same structure and function as the second command calculation unit 1115*a*-3 and the control command switching unit 1115*a*-5 of the training device 100 according to the first embodiment, and hence the description thereof is omitted.

The first command calculation unit 2115*a*-1 calculates the first motor control command based on the force component signal (Y-axis direction force component signal) output from the corresponding force detection unit (Y-axis direction force detection unit 175), in the same manner as the first command calculation unit 1115*a*-1 in the first embodiment.

However, the first command calculation unit 2115*a*-1 in the second embodiment is connected to the Y-axis direction force detection unit 175 via the force component signal correction unit 2115*a*-7. Thus, the first command calculation unit 2115*a*-1 can receive the force component signal after applying the drift correction, as the force component signal.

In addition, when calculating the first motor control command, the first command calculation unit 2115*a*-1 refers to calibration data stored in the force component signal correction unit 2115*a*-7, and calculates the force component values based on the calibration data. The force component values are component values in the directions of degree of freedom of the force applied to the operation rod 3. Further, the first command calculation unit 2115*a*-1 calculates the first motor control command based on the force component value described above.

In this way, even if the plurality of force detection units have different characteristics, or if the characteristics of the force detection unit changes due to a temporal variation or a temperature variation, the force applied to the operation rod 3 (force component) can be correctly detected by the plurality of force detection unit. Thus, the operation rod 3 can be operated more correctly based on the correctly detected force.

The force component signal correction unit 2115*a*-7 is connected to the corresponding force detection unit (Y-axis direction force detection unit 175) in a manner capable of transmitting and receiving signals. Thus, the force component signal correction unit 2115*a*-7 can receive the force component signal from the corresponding force detection unit (Y-axis direction force detection unit 175).

In addition, the force component signal correction unit 2115*a*-7 can transmit and receive signals to and from the operation command unit 1111. Thus, when the operation command unit 1111 generates the updated calibration data, the force component signal correction unit 2115*a*-7 can receive the updated calibration data from the operation command unit 1111. In this way, the force component signal correction unit 2115*a*-7 can update the stored calibration data.

Further, the force component signal correction unit 2115*a*-7 can receive the drift correction command from the operation command unit 1111, for example. The drift correction command may be output from the training instruction unit 5. In this way, when receiving the drift correction command, the force component signal correction unit 2115*a*-7 can calculate the drift correction value to be used for performing the drift correction on the received force component signal.

In addition, the force component signal correction unit 2115*a*-7 is connected to the first command calculation unit 2115*a*-1 in a manner capable of transmitting and receiving signals. Thus, the force component signal correction unit 2115*a*-7 can transmit the force component signal after the drift correction and the calibration data to the first command calculation unit 2115*a*-1.

III. Structure of Force Component Signal Correction Unit

Figure 10:
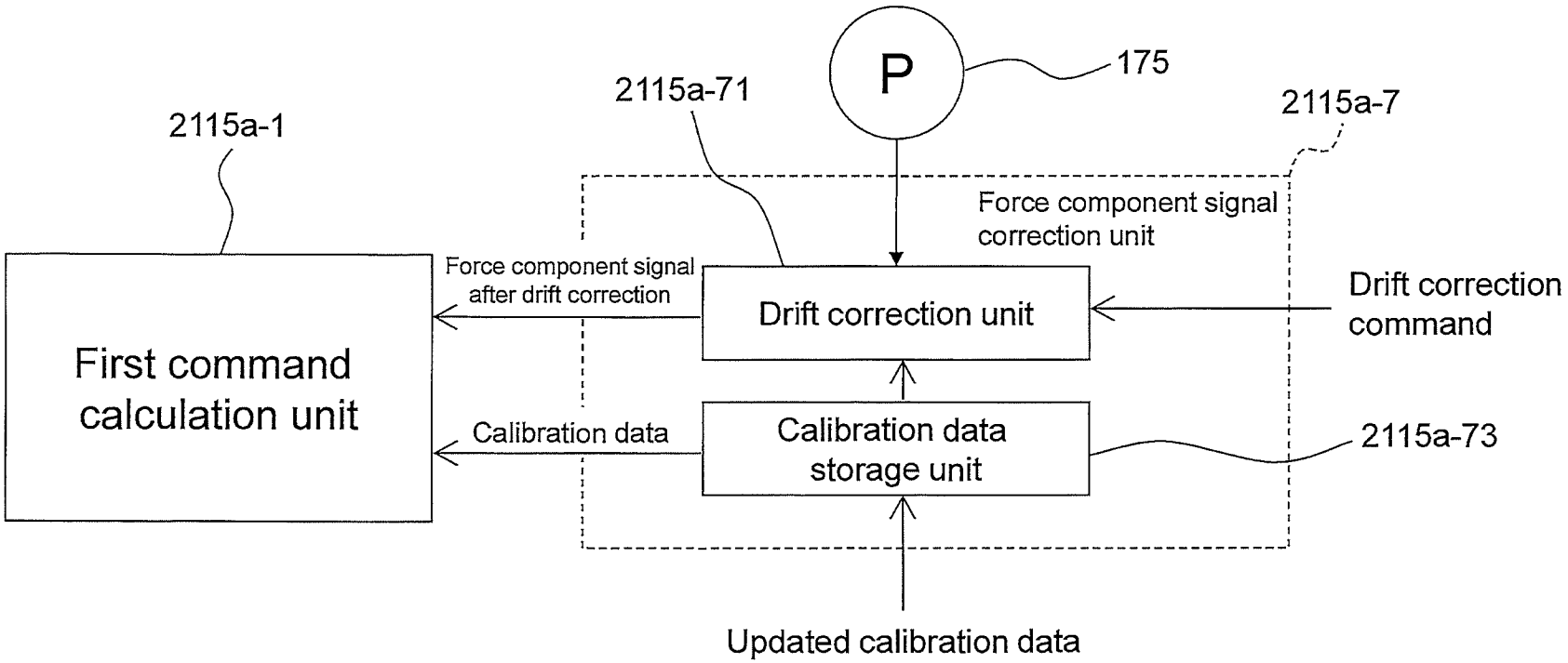
FIG. 10 is a diagram illustrating a structure of a force component signal correction unit.

The details of the structure of the force component signal correction unit 2115*a*-7 are described below with reference to FIG. 10. The force component signal correction unit 2115*a*-7 includes a drift correction unit 2115*a*-71 and a calibration data storage unit 2115*a*-73.

The drift correction unit 2115*a*-71 is connected to the force detection unit (the Y-axis direction force detection unit 175) and the first command calculation unit 2115*a*-1 in a manner capable of transmitting and receiving signals. Thus, the drift correction unit 2115*a*-71 can receive the force detect signal. In addition, the drift correction unit 2115*a*-71 can output the force component signal after the drift correction to the first command calculation unit 2115*a*-1.

In addition, the drift correction unit 2115*a*-71 can receive the drift correction command. In this way, when receiving the drift correction command, the drift correction unit 2115*a*-71 can perform the drift correction on the received force detect signal.

Here, the drift correction performed by the drift correction unit 2115*a*-71 is described. As described above, the characteristics of the potentiometer constituting the force detection unit (Y-axis direction force detection unit 175) are changed due to influence of temperature or the like. If the characteristics are changed in this way, the current flowing in the potentiometer constituting the force detection unit is changed.

In this case, the signal value of the force component signal when the tilt angle $\theta_F$ is zero (namely, the force becomes zero) changes due to the change of the characteristics. This variation of the signal value of the force component signal when the force is zero is referred to as a "drift".

The drift correction unit 2115*a*-71 performs the process of removing the drift (drift correction) on the received force component signal and transmits the force component signal after the drift correction to the first command calculation unit.

Specifically, the drift correction unit 2115*a*-71 performs the drift correction on the received force component signal, on the basis of a signal value difference (drift correction value) between the signal value of the force component signal when the predetermined force is zero (the tilt angle $\theta_F$ is zero) and the signal value (measured value) of the actual force component signal when the operation position (tilt angle) of the operation rod 3 is zero (also referred to as a reference position) and when no power is applied to the operation rod 3 (namely the force components in the directions of degree of freedom are zero).

In this way, it is possible to correct the drift of the force component signal due to the characteristics change of the force detection unit (Y-axis direction force detection unit 175) caused by outside temperature variation or the like. As a result, even if the characteristics of the force detection unit changes, it is possible to output the correct force component signal corresponding to the force applied to the operation rod 3 (force component).

The calibration data storage unit 2115*a*-73 corresponds to a storage area of the storage device (such as a RAM, a ROM, or a hard disk) of the microcomputer system constituting the control unit 11 or the motor control command unit 2115*a*. The calibration data storage unit 2115*a*-73 stores the calibration data. When the first command calculation unit 2115*a*-1 refers to the calibration data, the calibration data storage unit 2115*a*-73 transmits the calibration data to the first command calculation unit 2115*a*-1.

The calibration data represents a relationship between the signal value of the force component signal (Y-axis direction force component signal) output from the corresponding force detection unit (Y-axis direction force detection unit 175) and the magnitude of the force component (in the Y-axis direction) detected by the corresponding force detection unit (Y-axis direction force detection unit 175).

In other words, the calibration data is data representing a variation amount of the force applied to the operation rod 3 with respect to the variation of the signal value of the force component signal. In addition, as described later, the calibration data contains information about the variation amount of the force applied to the operation rod 3 with respect to the variation of the signal value of the force component signal for each of the three force correction units (the Y-axis direction force detection unit 175, the X-axis direction force detection unit 177, and the expansion detection unit 393).

Since the first command calculation unit 2115*a*-1 calculates the force component from the force component signal using the calibration data, even if the characteristics of the force detection unit (Y-axis direction force detection unit 175) are different from those of the other force detection unit, or if the characteristics of the force detection unit (Y-axis direction force detection unit 175) are changed due to long-term use of the training device, the force applied to the operation rod 3 (force component) can be correctly calculated.

In addition, the calibration data storage unit 2115*a*-73 can receive the updated calibration data from the operation command unit 1111. In this way, the calibration data storage unit 2115*a*-73 can replace the currently stored calibration data with the received updated calibration data, so as to store the new calibration data. As a result, even if the individual difference of the force detection unit (Y-axis direction force detection unit 175) or the biasing member 179 is changed due to long-term use, the calibration data storage unit 2115*a*-73 updates the calibration data, and hence the calibration data corresponding to the variation can be maintained.

Figure 11:
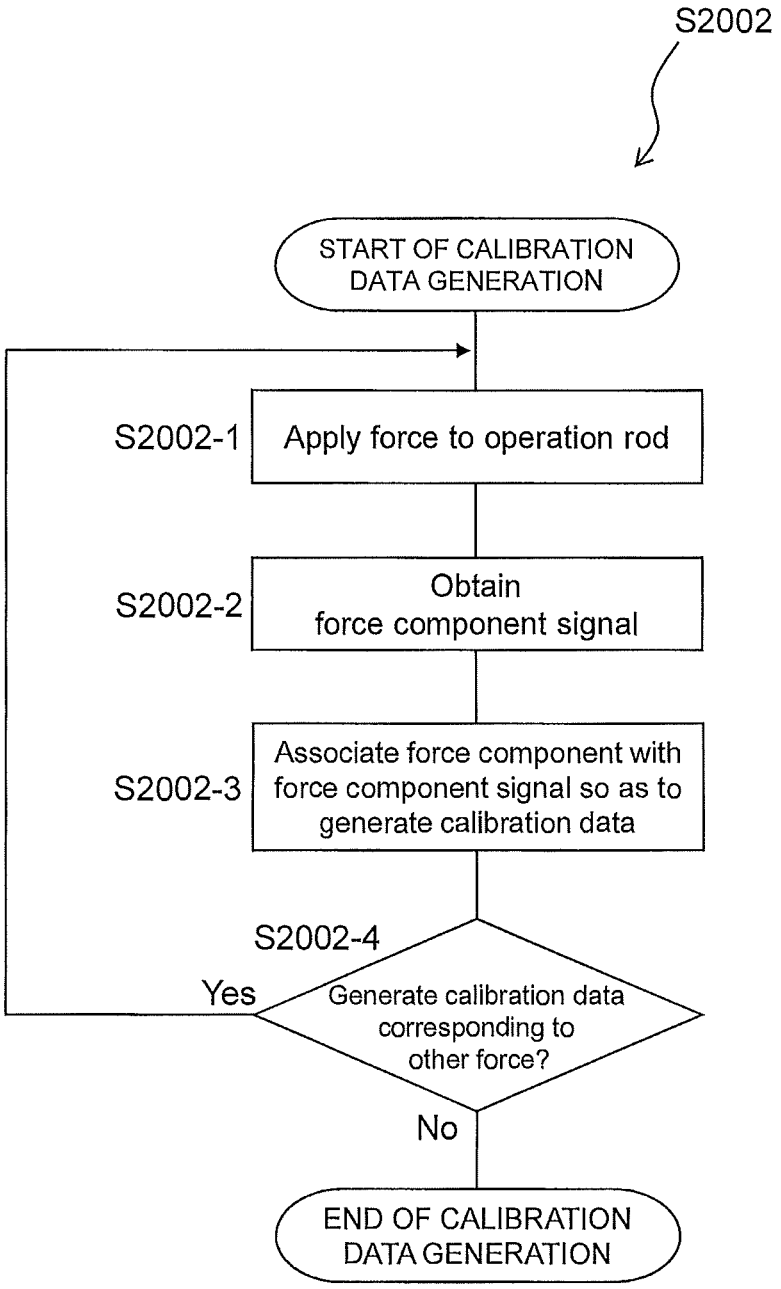
FIG. 11 is a flowchart illustrating a method for generating calibration data.

IV. Operation of Training Device According to Second Embodiment (i) Generation of Calibration Data Next, the operation of the training device 200 according to the second embodiment is described. First, the generation of the calibration data to be used in the training device 200 according to the second embodiment is described with reference to FIG. 11. FIG. 11 is a flowchart illustrating a method for generating the calibration data. It should be noted that the generation of the updated calibration data is also performed in the same manner.

When the generation of the calibration data starts, a force with a predetermined magnitude and direction is first applied to the operation rod 3 (Step S2002-1). In the state where the predetermined force is applied to the operation rod 3, the operation command unit 1111 obtains the Y-axis direction force component signal output from the Y-axis direction force detection unit 175, the X-axis direction force component signal output from the X-axis direction force detection unit 177, and the length direction force component signal output from the expansion detection unit 393 (Step S2002-2).

Next, the operation command unit 1111 associates the force component in the X-axis direction (X-axis direction force component value), the force component in the Y-axis direction (Y-axis direction force component value), and the force component in the length direction (length direction force component value) of the predetermined force applied to the operation rod 3 respectively with the X-axis direction force component signal, the Y-axis direction force component signal, and the length direction force component signal corresponding to the force components, so as to store in the calibration data (Step S2002-3). The force components can be calculated as components in the individual axis directions of the force applied to the operation rod 3, on the basis of the force and the direction of the force applied to the operation rod 3.

After that, the steps of (i) applying the force to the operation rod 3, (ii) obtaining the force component signals, and (iii) associating the force component signals with the force components to store them, are repeated while changing the force applied to the operation rod 3.

Specifically, first, it is determined whether or not to apply a force of other magnitude and/or direction to the operation rod 3 for generating the calibration data (Step S2002-4).

If it is determined to apply the force of other magnitude and/or direction to the operation rod 3 for generating the calibration data (in the case of "Yes" in Step S2002-4), the process returns to Step S2002-1, in which the force of other magnitude and/or direction is applied to the operation rod 3, and then the generation process of the calibration data is performed again.

On the other hand, if it is determined not to generate more calibration data (in the case of "No" in Step S2002-4), the generation process of the calibration data is finished.

As a result, the operation command unit 1111 generates the calibration data as illustrated in FIG. 12. FIG. 12 is a diagram illustrating a data structure of the calibration data.

The calibration data illustrated in FIG. 12 is calibration data that is generated when n types of forces are applied to the operation rod 3.

$V_{x1}, V_{x2}, \ldots V_{xn}$ of the calibration data illustrated in FIG. 12 represent signal values of the X-axis direction force component signal when Force 1, Force 2, . . . Force n are applied, respectively. $V_{y1}, V_{y2}, \ldots V_{yn}$ represent signal values of the Y-axis direction force component signal when Force 1, Force 2, . . . Force n are applied, respectively. $V_{L1}, V_{L2}, \ldots V_{Ln}$ represent signal values of the length direction force component signal when Force 1, Force 2, . . . Force n are applied, respectively.

On the other hand, $F_{x1}, F_{x2}, \ldots F_{xn}$ of the calibration data illustrated in FIG. 12 represent the X-axis direction force component values of Force 1, Force 2, . . . Force n, respectively. $F_{y1}, F_{y2}, \ldots F_{yn}$ represent the Y-axis direction force component values of Force 1, Force 2, . . . Force n, respectively. $F_{L1}, F_{L2}, \ldots F_{Ln}$ represent the length direction force component values of Force 1, Force 2, . . . Force n, respectively.

It should be noted that, in order to perform the drift correction using the calibration data, the calibration data stores signal values of the force component signals when the operation rod 3 is at the reference position (when the tilt angle of the operation rod 3 is zero).

The calibration data generated as described above may be transmitted to the calibration data storage unit 2115*a*-73 and stored therein after being generated, or the generated calibration data may be stored in the storage unit of the operation command unit 1111 or the like and transmitted to the calibration data storage unit 2115*a*-73 and stored therein when the training device 100 is activated.

It should be noted that the operation command unit 1111 generates the calibration data in the generation of the calibration data and the updated calibration data, but this is not a limitation. The calibration data (and the updated calibration data) may be generated by the first command calculation unit 2115*a*-1 in the same manner as the method described above.

(ii) Method for Calculating Drift Correction Value Using Calibration Data

Figure 13:
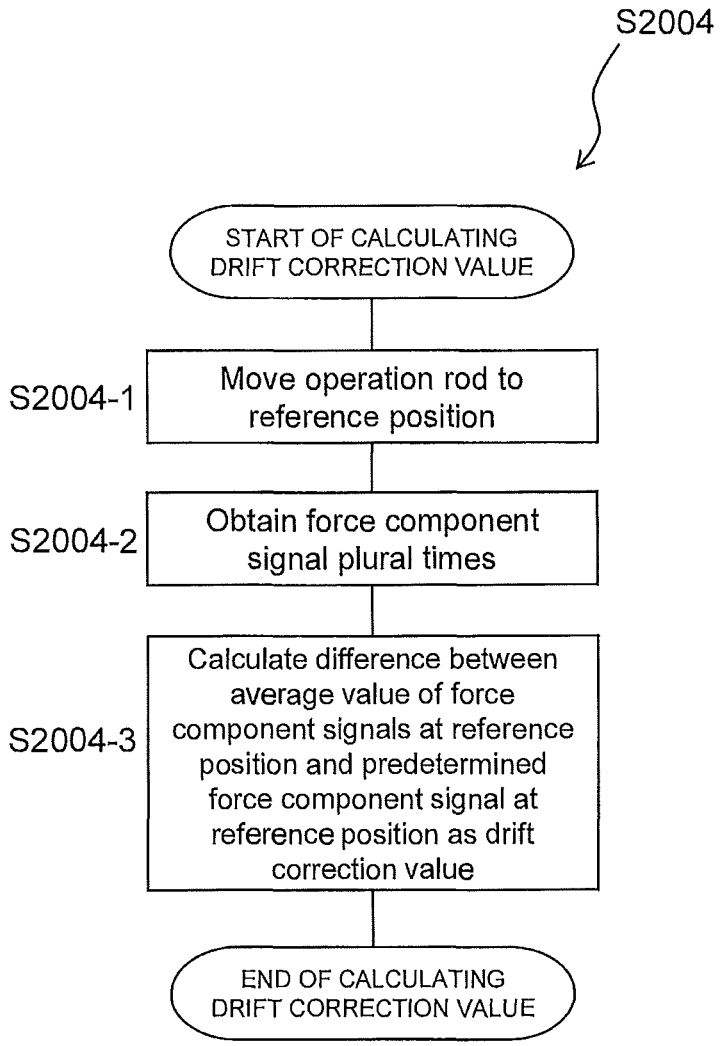
FIG. 13 is a flowchart illustrating a method for calculating a drift correction value.

Next, a method for calculating the drift correction value using the calibration data is described with reference to FIG. 13. FIG. 13 is a flowchart illustrating a method for calculating the drift correction value. In the following description, a method of determining the drift correction value in the drift correction unit 2115*a*-71 is exemplified for description. It is because the drift correction values are also determined in other drift correction units 2115*b*-71 and 2115*c*-71 in the same manner.

First, the operation rod 3 is moved to the reference position (Step S2004-1). In this case, no force is applied to the operation rod 3. Next, the drift correction unit 2115*a*-71 obtains the signal value of the force component signal of the force detection unit (Y-axis direction force detection unit 175) plural times, while keeping the operation rod 3 at the reference position (Step S2004-2).

After obtaining the signal value of the force component signal of the force detection unit (Y-axis direction force detection unit 175) plural times, the drift correction unit 2115*a*-71 calculates the drift correction value that is a difference between an average value of the obtained force component signals at the reference position and the signal value of the force component signal of the calibration data stored in the calibration data storage unit 2115*a*-73 when the operation rod 3 is at the reference position (when the force component value is zero) (Step S2004-3).

As described above, by calculating the drift correction value using the calibration data, it is possible to perform the drift correction using the calibration data as described later. In this way, the drift correction unit 2115*a*-71 can perform the drift correction of the force component signal to correspond to the calibration data.

After calculating the drift correction value, the drift correction unit 2115*a*-71 stores the drift correction value calculated for performing the drift correction on the force component signal output from the force detection unit (Y-axis direction force detection unit 175), during execution of the training program.

It should be noted that the calculation of the drift correction value is not necessarily performed by the drift correction unit 2115*a*-71. The calculation of the drift correction value may be performed by the operation command unit 1111. In this case, the calculated drift correction value is transmitted from the operation command unit 1111 to the storage unit of the drift correction unit 2115*a*-71 and is stored therein.

(iii) Overall Operation of Training Device According to Second Embodiment

Figure 14:
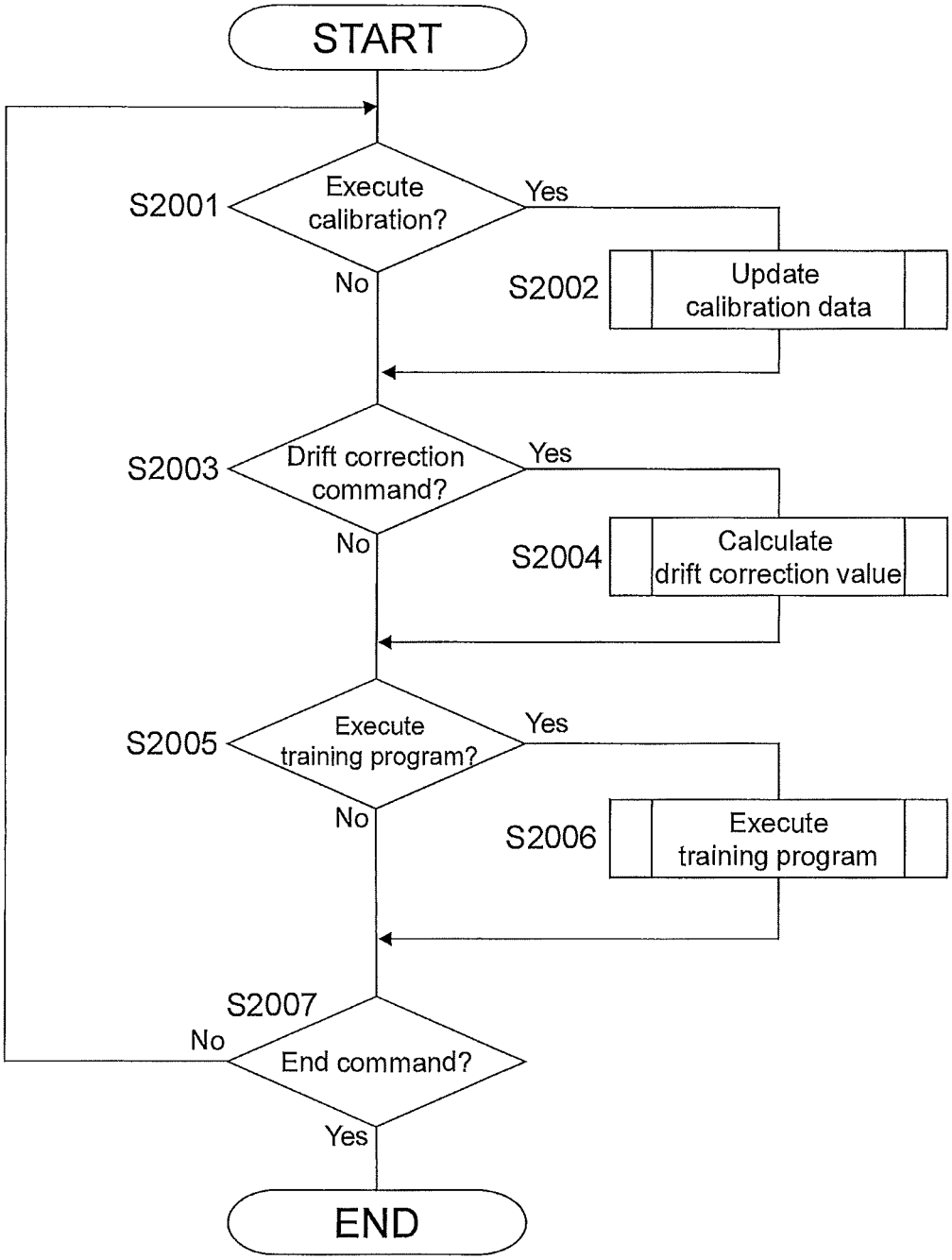
FIG. 14 is a flowchart illustrating an operation of the training device according to the second embodiment.

Next, the overall operation of the training device 200 according to the second embodiment is described with reference to FIG. 14. FIG. 14 is a flowchart illustrating an operation of the training device according to the second embodiment.

When the training device 200 according to the second embodiment starts its operation, it is monitored whether or not the operation command unit 1111 (or the first command calculation unit 2115*a*-1, 2115*b*-1, 2115*c*-1) has received the command (calibration command) for performing the calibration from the training instruction unit 5 or the like (Step S2001).

If the operation command unit 1111 has received the calibration command (in the case of "Yes" in Step S2001), the calibration data is updated (Step S2002).

On the other hand, if the operation command unit 1111 or the like has not received the calibration command (in the case of "No" in Step S2001), the process proceeds to Step S2003.

After receiving the calibration command, the operation command unit 1111 updates the calibration data (Step S2002). Specifically, for example, the operation command unit 1111 or the first command calculation unit 2115*a*-1 generates the updated calibration data by the above-described method for generating the calibration data and overwrites the generated updated calibration data on the calibration data currently stored in the calibration data storage unit 2115*a*-73, 2115*b*-73, 2115*c*-73, so as to update the calibration data.

Since the operation command unit 1111 updates the calibration data as described above, the updates of the calibration data can be centralized.

In addition, by updating the calibration data when the calibration command is issued, the calibration data corresponding to the characteristics change of the force detection unit can be stored as new calibration data in the calibration data storage unit 2115*a*-73, 2115*b*-73, 2115*c*-73.

If the calibration command is not received in Step S2001 (in the case of "No" in Step S2001), or after updating the calibration data in Step S2002, the drift correction unit 2115*a*-71, 2115*b*-71, 2115*c*-71 (or the operation command unit 1111) determines whether or not it has received the drift correction command (Step S2003).

If the drift correction unit 2115*a*-71, 2115*b*-71, 2115*c*-71 (or the operation command unit 1111) has not received the drift correction command (in the case of "No" in Step S2003), the process proceeds to Step S2005.

On the other hand, if the drift correction unit 2115*a*-71, 2115*b*-71, 2115*c*-71 (or the operation command unit 1111) has received the drift correction command (in the case of "Yes" in Step S2003), the drift correction unit 2115*a*-71, 2115*b*-71, 2115*c*-71 (or the operation command unit 1111) calculates the drift correction value for performing the drift correction by the method described above (Step S2004).

The drift correction command is output only once in the initial operation executed when the training device 200 is activated (when the power is turned on), for example.

If the drift correction command is not received in Step S2003 (in the case of "No" in Step S2003), or after calculating the drift correction value in Step S2004, the training device 200 determines whether or not it has received a command for executing the training program (Step S2005).

If the training device 200 has not received the command for executing the training program (in the case of "No" in Step S2005), the process proceeds to Step S2007.

On the other hand, if the training device 200 has received the command for executing the training program (in the case of "Yes" in Step S2005), the training device 200 executes the training program (Step S2006).

The execution of the training program in Step S2006 is performed in accordance with the flowchart illustrated in FIG. 8A. In other words, the execution of the training program by the training device 200 is substantially the same as the execution of the training program by the training device 100 according to the first embodiment.

Figure 15:
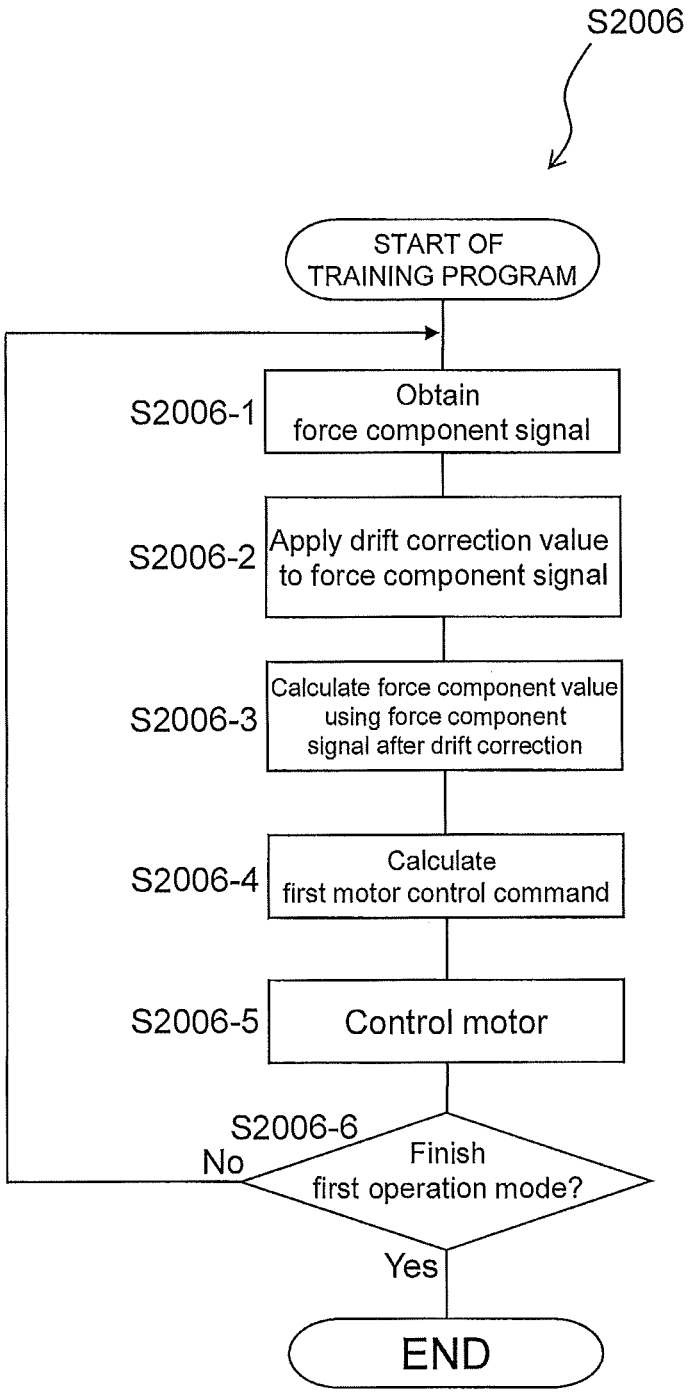
FIG. 15 is a flowchart illustrating a method for executing a training program (first operation mode) in the second embodiment.

However, when obtaining the force component signal from the corresponding force detection unit (Y-axis direction force detection unit 175) (when executing Step S21 in the flowchart illustrating execution of the first operation mode in FIG. 8B) in execution of the first operation mode of the training program (in execution of Step S2 in the flowchart of FIG. 8A), the training device 200 of the second embodiment performs the drift correction on the force component signal output from the force detection unit. Then, the training device 200 calculates the force component value of the force applied to the operation rod 3 using the calibration data on the force component signal after the drift correction. After that, the training device 200 calculates the first motor control command based on the force component value in Step S22 in which the first motor control command is calculated. Specifically, the training program (first operation mode) according to the second embodiment is executed in accordance with the flow of the process in the flowchart illustrated in FIG. 15. FIG. 15 is a flowchart illustrating the method for executing the training program (first operation mode) according to the second embodiment.

First, every time obtaining the force component signal from the force detection unit (Y-axis direction force detection unit 175) (Step S2006-1), the drift correction unit 2115*a*-71 perform the drift correction on the force component signal (Step S2006-2) by applying the drift correction value to the obtained force component signal. Specifically, the drift correction unit 2115*a*-71 calculates a difference between the obtained force component signal and the stored drift correction value as the force component signal after the drift correction.

"Applying the drift correction value" does not necessarily mean to calculate the difference between the obtained force component signal and the drift correction value. It is possible to adopt one of various methods for calculating (drift correction) the force component signal after the drift correction, in accordance with the characteristics change of the force detection unit (for example, how the characteristics changes along with temperature variation). For example, it is possible to calculate a ratio of the force component signal to the drift correction value for performing the drift correction, or to add the drift correction value to the force component signal for performing the drift correction.

As described above, by applying the drift correction value to the force component signal, the drift correction unit 2115*a*-71 can perform the drift correction, so that the obtained force component signal corresponds to the calibration data (the signal value when the force component in the obtained force component signal is zero becomes identical to the signal value when the force component stored in the calibration data is zero).

After performing the drift correction of the obtained force component signal, the drift correction unit 2115*a*-71 outputs the force component signal after the drift correction to the first command calculation unit 2115*a*-1.

After obtaining the force component signal after the drift correction from the drift correction unit 2115*a*-71, the first command calculation unit 2115*a*-1 calculates the force component value (in the Y-axis direction) of the force applied to the operation rod 3 using the force component signal after the drift correction (Step S2006-3).

Specifically, the first command calculation unit 2115*a*-1 first finds where the force component signal after the drift correction exists between corresponding force component signals stored in the calibration data (Y-axis direction force component signals $V_{y1}$, $V_{y2}$, . . . $V_{ym}$ in the first command calculation unit 2115*a*-1).

As a result, it is supposed, for example, that the force component signal after the drift correction are found to exist between the Y-axis direction force component signals $V_{yk}$ and $V_{y(k+1)}$ in the calibration data.

Next, the first command calculation unit 2115*a*-1 calculates the force component corresponding to the force component signal after the drift correction, by using the two found Y-axis direction force component signals $V_{yk}$ and $V_{y(k+1)}$ in the calibration data, as well as force component values $F_{yk}$ and $F_{y(k+1)}$ associated to the two Y-axis direction force component signals $V_{yk}$ and $V_{y(k+1)}$, respectively.

Specifically for example, in a coordinate system of the Y-axis direction force component signal value in the calibration data and the corresponding force component value, a function (F=aV+b) representing a straight line passing the coordinates ($V_{yk}$, $F_{yk}$) and the coordinates ($V_{y(k+1)}$, $F_{y(k+1)}$) is defined. Then, a force component value F when the Y-axis direction force component value V becomes a value corresponding to the force component signal after the drift correction in the above function is calculated as the force component value after the drift correction (linear interpolation).

It should be that the above function is not limited to the function representing a straight line but can be defined as an arbitrary function passing the two coordinates described above. Which function is defined can be determined in accordance with the characteristics of the force detection unit.

In addition, if the Y-axis direction force component signal that is identical to the signal value of the force component signal after the drift correction exists in the calibration data, the force component value associated with this Y-axis direction force component signal can be set as the force component value of the force that is actually applied to the operation rod 3.

As described above, since the drift correction unit 2115*a*-71 performs the drift correction of the force component signal in the corresponding force detection unit (Y-axis direction force detection unit 175), the drift of the force component signal due to the characteristics change of the corresponding force detection unit (Y-axis direction force detection unit 175) can be corrected. As a result, the first command calculation unit 2115*a*-1 can obtain the accurate force component value corresponding to the force (force component) applied to the operation rod 3.

In addition, since the first command calculation unit 2115*a*-1 calculates the force component value based on the calibration data, even if the characteristics of the corresponding force detection unit (Y-axis direction force detection unit 175) are different from the characteristics of the other force detection unit, or if the characteristics of the corresponding force detection unit are changed due to long-term use, the force (force component) applied to the operation rod 3 can be correctly calculated.

Further, since the drift correction unit 2115*a*-71 calculates the drift correction value using the calibration data and performs the drift correction of the force component signal using the drift correction value, the drift of the force component signal can be corrected so that the force component signal corresponds to the calibration data.

After calculating the force component value, the first command calculation unit 2115*a*-1 calculates the first motor control command based on the calculated force component value (Step S2006-4). In this way, the first command calculation unit 2115*a*-1 can calculate the first motor control command based on the force that is actually applied to the operation rod 3.

After that, the motor is controlled in accordance with the calculated first motor control command (Step S2006-5). In this way, the motor is appropriately controlled based on the force that is actually applied to the operation rod 3.

Next, the first command calculation unit 2115*a*-1 monitors whether or not the first operation mode is finished (Step S2006-6). Specifically, for example, when the training instruction unit 5 instructs to stop the execution of the Free Mode, the first command calculation unit 2115*a*-1 can monitor whether or not the first operation mode is finished.

If it is determined that the first operation mode is finished (in the case of "Yes" in Step S2006-6), the first command calculation unit 2115*a*-1 stops the detection of the force and stops the calculation of the first motor control command (end of the first operation mode).

On the other hand, if it is determined that the first operation mode is being executed (continued) (in the case of "No" in Step S2006-6), the execution process of the training program returns to Step S2006-1, so as to continue the detection of the force and the calculation of the first motor control command.

If it is determined not to execute the training program in Step S2005, or after the execution of the training program, the training device 200 monitors whether or not it is commanded to finish the operation of the training device 200 by an operator of the training device 200 (for example, a patient who undergoes the training of the limb or an assistant for training the limb), for example (Step S2007).

If it is commanded to finish the operation of the training device 200 (in the case of "Yes" in Step S2007), the operation of the training device 200 is finished.

On the other hand, if the command to finish the operation of the training device 200 is not received (in the case of "No" in Step S2007), the process returns to Step S2001, in which the training device 200 continues the operation.

(7) Third Embodiment

I. Gravity Correction

The training devices 100 and 200 according to the first embodiment and the second embodiment detect the force without considering the operation position (tilt angle, expansion and contraction length) of the operation rod 3. However, this is not a limitation. A training device 300 according to a third embodiment takes the operation position (tilt angle, expansion and contraction length) of the operation rod 3 into consideration so as to correct the detected force. Hereinafter, there is described the training device 300 according to the third embodiment, which corrects the detected force by considering the operation position of the operation rod 3.

First, there is described an influence to the detected force when the operation rod 3 is moved (tilted) from the reference position (without tilt of the operation rod 3) or when the length of the operation rod 3 is changed at the position after the movement (tilt).

When the operation rod 3 is at the reference position, the gravity acts on the operation rod 3 and the cover 353 of the telescoping mechanism 35 in the vertical direction (length direction). In this case, no force acts on the force detection mechanism 17 in theory (because the force detection mechanism 17 is pivotally supported at the operation rod tilt mechanism 13). On the other hand, the expansion detection unit 393 outputs a force component signal that is not zero.

Figure 16:
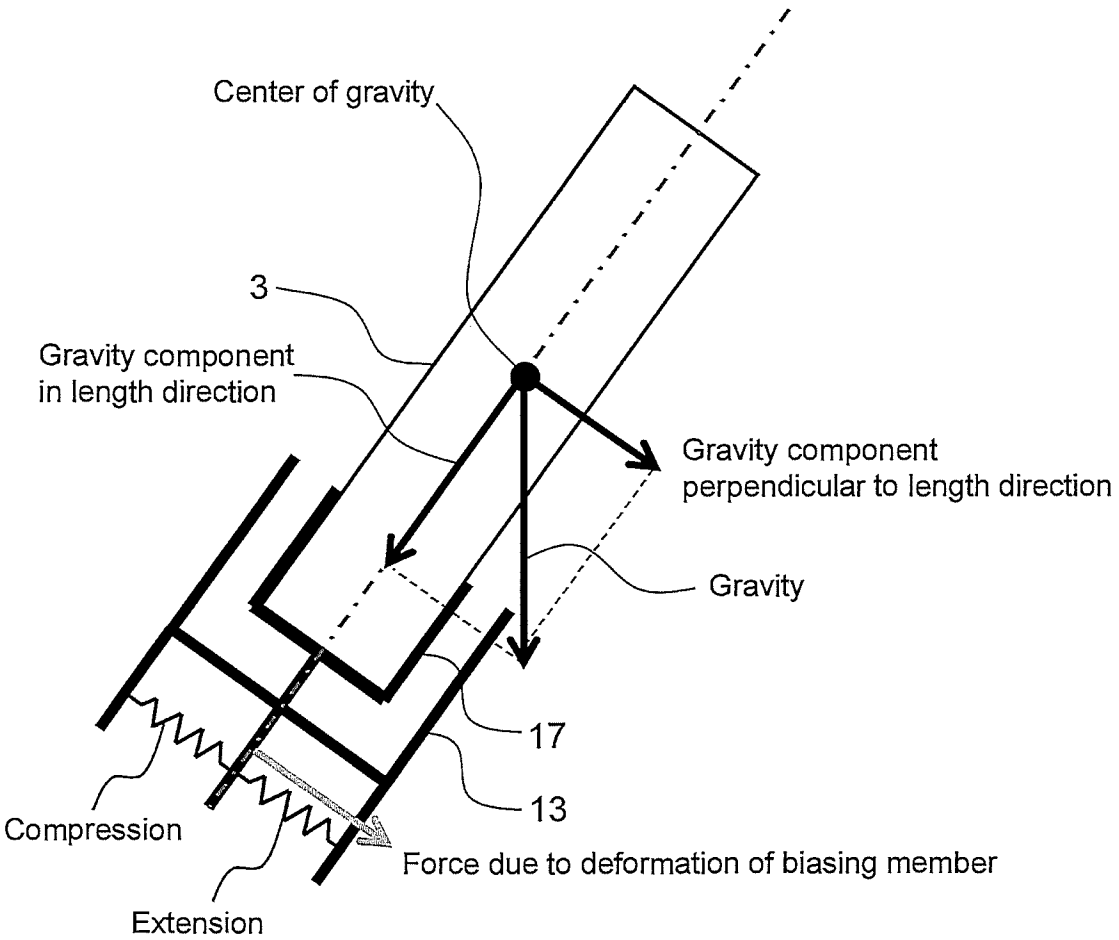
FIG. 16 is a diagram schematically illustrating a force applied to the force detection mechanism when the operation rod is tilted.

On the other hand, when the operation rod 3 is tilted in the X-axis direction and/or the Y-axis direction, gravity components in the length direction and in a direction perpendicular to the length direction act on the operation rod 3 as illustrated in FIG. 16. Therefore, the force detection mechanism 17 changes its shape so as to generate a force to be balanced with the gravity component in the direction perpendicular to the length direction (in the example illustrated in FIG. 16, the left side of the biasing member 179 is compressed while the right side thereof is expanded). It should be noted that, since the force detection mechanism 17 is pivotally supported at the operation rod tilt mechanism 13, the gravity component in the length direction does not act on the force detection mechanism 17. Because of the shape change of the biasing member 179, the force detection units 175 and 177 also output the force component signals that are not zero.

In this case, when executing the first operation mode in which the operation rod 3 is operated based on the force applied to the operation rod 3, due to the above-described force component signal that is not zero, the operation rod 3 may move in spite that no force is applied to the operation rod 3 by the limb of the patient or the like. Alternatively, when executing the first operation mode, a force different from the force actually applied to the operation rod 3 by the limb of the patient or the like may be detected by the force detection mechanism 17, and as a result, the operation rod 3 cannot be controlled as the patient or the like intends based on the actually applied force.

In addition, if the length of the operation rod 3 changes while the operation rod 3 is tilted, the magnitude of the gravity component is also changed due to the change in the length of the operation rod 3 because the position of the center-of-gravity of the operation rod 3 is changed. Therefore, the training device 300 according to the third embodiment performs the correction for eliminating the influence of the gravity component (which may be referred to as gravity correction) on the force detected when the operation rod 3 is tilted.

II. Structure of Training Device According to Third Embodiment

Next, the structure of the training device 300 according to the third embodiment, which eliminates the influence of the gravity component, is described.

The structure of the training device 300 according to the third embodiment is substantially the same as the structure of the training device 100 according to the first embodiment or the training device 200 according to the second embodiment, except that three motor control command units 3115*a*, 3115*b*, and 3115*c* include force correction units 3115*a*-7, 3115*b*-7, and 3115*c*-7, respectively. Therefore, only the structure of the three motor control command units 3115*a*, 3115*b*, and 3115*c* is described, and the descriptions of other structures are omitted.

Figure 17:
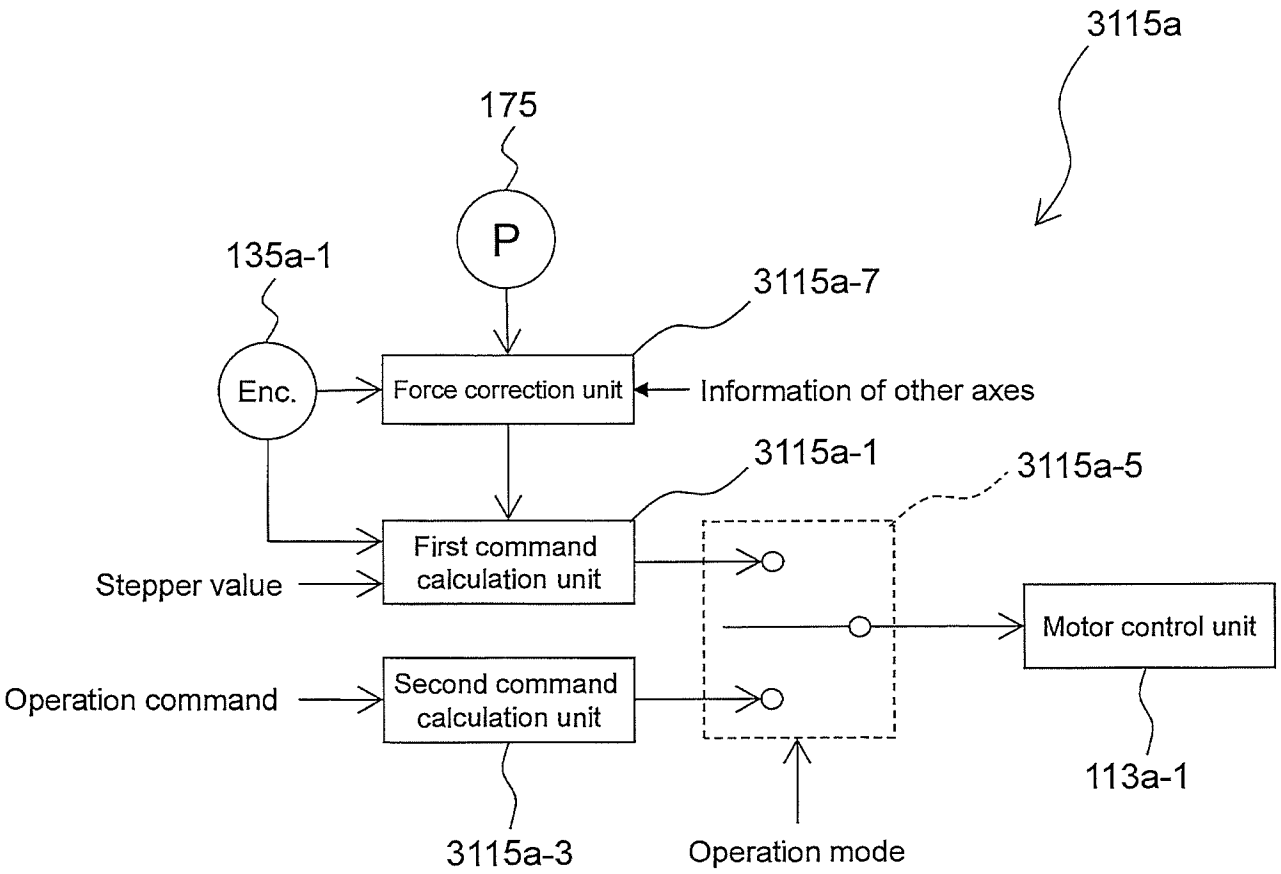
FIG. 17 is a diagram illustrating a structure of the motor control command unit of the training device according to a third embodiment.

In addition, in the following description, with reference to FIG. 17, the structure of the motor control command unit 3115*a* is exemplified for description. It is because other motor control command units 3115*b* and 3115*c* have the same structure and function as the motor control command unit 3115*a*. FIG. 17 is a diagram illustrating the structure of the motor control command unit of the training device according to the third embodiment.

It should be noted that the functions of the elements of the motor control command units 3115*a*, 3115*b*, and 3115*c* described below may be realized as a microcomputer system constituting the control unit 11 or as a program executed by the microcomputer system constituting the motor control command units 3115*a*, 3115*b*, and 3115*c*.

The motor control command unit 3115*a* includes a first command calculation unit 3115*a*-1, a second command calculation unit 3115*a*-3, a control command switching unit 3115*a*-5, and a force correction unit 3115*a*-7.

The structure and the function of each of the second command calculation unit 3115*a*-3 and the control command switching unit 3115*a*-5 are the same as those of the second command calculation units 1115*a*-3 and 2115*a*-5, and the control command switching units 1115*a*-5 and 2115*a*-3 in the first embodiment and the second embodiment. Therefore, the descriptions thereof are omitted.

The structure and the function of the first command calculation unit 3115*a*-1 are basically the same as those of the first command calculation units 1115*a*-1 and 2115*a*-1 in the first embodiment and the second embodiment. However, the first command calculation unit 3115*a*-1 in the third embodiment is connected to the force correction unit 3115*a*-7 in a manner capable of transmitting and receiving signals. In other words, the first command calculation unit 3115*a*-1 is connected to the corresponding force detection unit (Y-axis direction force detection unit 175) via the force correction unit 3115*a*-7.

Therefore, the first command calculation unit 3115*a*-1 receives the corrected force component value calculated by the force correction unit 3115*a*-7, and calculates the first motor control command based on the received corrected force component value. In this way, when executing the first operation mode, it is possible to suppress an unintended operation of the operation rod 3.

The force correction unit 3115*a*-7 is connected to the corresponding force detection unit (Y-axis direction force detection unit 175) in a manner capable of transmitting and receiving signals. Thus, the force correction unit 3115*a*-7 can obtain the force component signal output from the corresponding force detection unit (Y-axis direction force detection unit 175).

In addition, the force correction unit 3115*a*-7 is connected to the corresponding rotation information output sensor (first rotation information output sensor 135*a*-1) in a manner capable of transmitting and receiving signals. Thus, the force correction unit 3115*a*-7 can obtain the operation position (tilt angle) in the corresponding direction of degree of freedom (Y-axis direction).

Further, the force correction unit 3115*a*-7 can receive, from the operation command unit 1111, the operation position in other directions of degree of freedom (other axis information) including the operation position in at least the length direction of the operation rod 3 (namely the length of the operation rod 3).

In this way, the force correction unit 3115*a*-7 can calculate the corrected force component value based on the operation position of the operation rod 3 and the force component signal.

III. Operation of Training Device According to Third Embodiment

Figure 18:
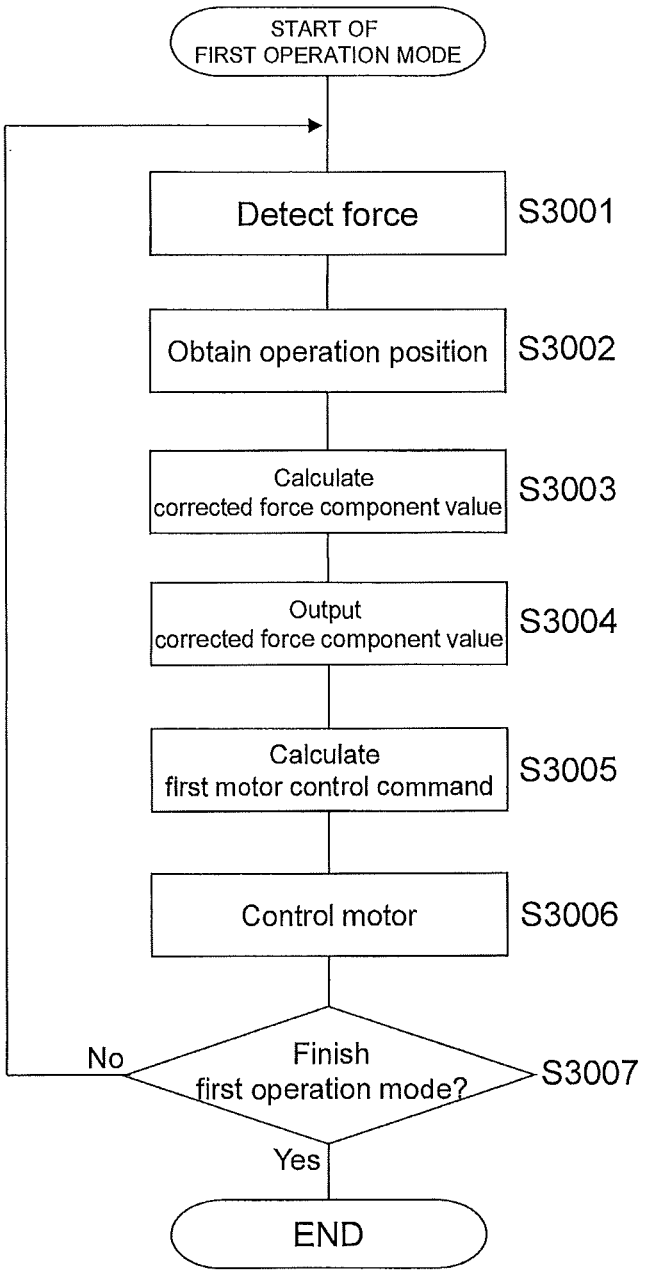
FIG. 18 is a flowchart illustrating an operation when executing the first operation mode of the training device according to the third embodiment.

Next, the operations of the training device 300 according to the third embodiment, which performs the correction of the force component signal, are described with reference to FIG. 18. It should be noted that, among the operations of the training device 300 according to the third embodiment, only the operation when executing the first operation mode is described with reference to FIG. 18, and the descriptions of other operations are omitted. It is because other operations are the same as those of the training device 100 according to the first embodiment or the training device 200 according to the second embodiment. FIG. 18 is a flowchart illustrating the operation of the training device according to the third embodiment when executing the first operation mode.

When the training device 300 starts the first operation mode, the force correction unit 3115*a*-7 obtains the force component signal from the corresponding force detection unit (Y-axis direction force detection unit 175) (Step S3001).

Next, the force correction unit 3115*a*-7 obtains the operation position (tilt angle) in the corresponding direction of degree of freedom (Y-axis direction) of the operation rod 3 from the corresponding rotation information output sensor (first rotation information output sensor 135*a*-1). In addition, the force correction unit 3115*a*-7 obtains the other axis information including the operation position in at least the length direction of the operation rod 3 from the operation command unit 1111 (Step S3002).

After obtaining the corresponding force component signal and the operation position of the operation rod 3, the force correction unit 3115*a*-7 calculates the corrected force component value based on the obtained operation position of the operation rod 3 and the force component value calculated from the force component signal (Step S3003).

Figure 19:
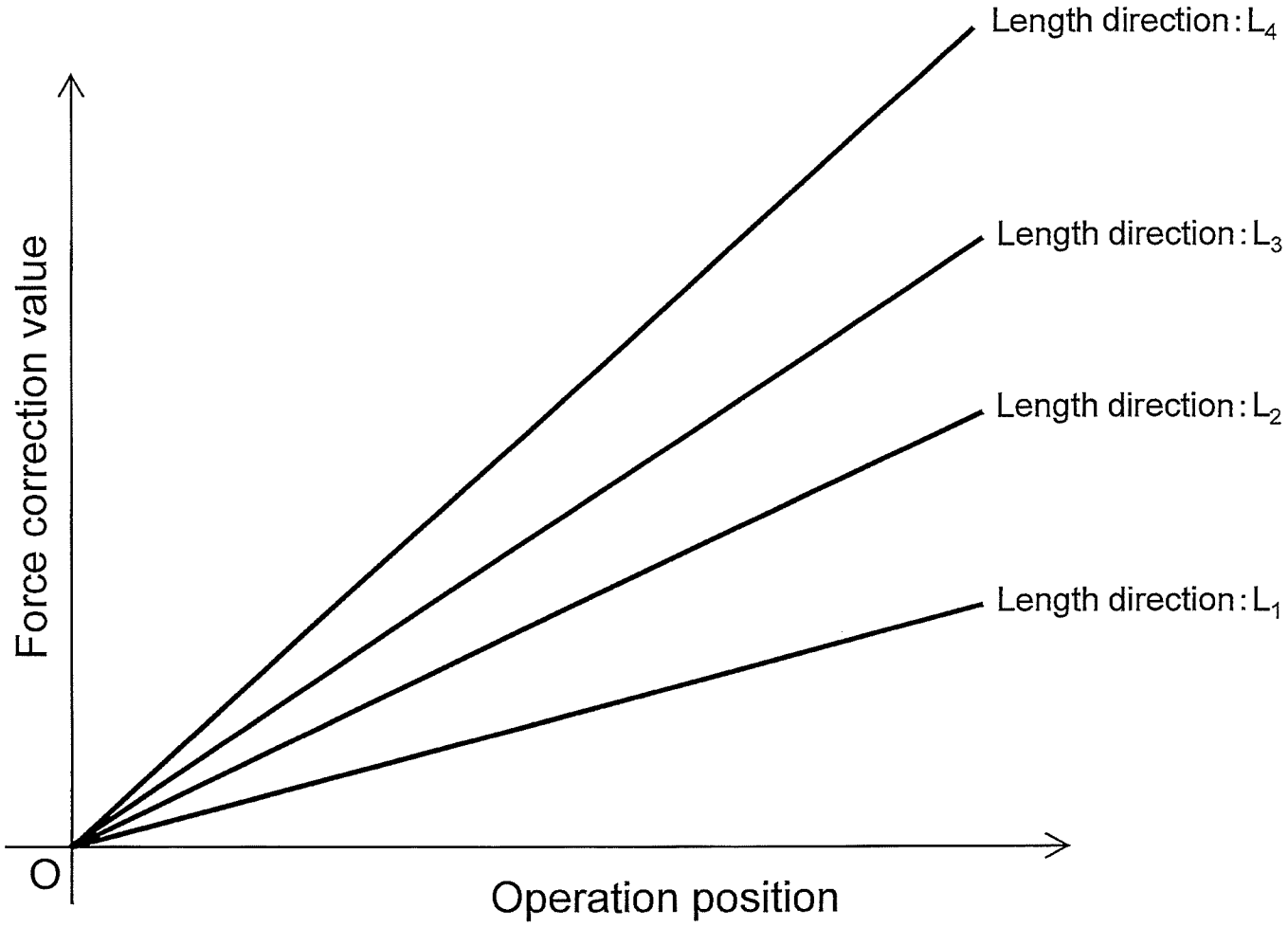
FIG. 19 is a diagram illustrating a relationship between an operation position of the operation rod and a force correction value.

In this embodiment, the force correction unit 3115*a*-7 corrects the force component value calculated from the force component signal, on the basis of the relationship between the predetermined operation position of the operation rod 3 and the force correction value as illustrated in FIG. 19. FIG. 19 is a diagram illustrating a relationship between the operation position of the operation rod and the force correction value. FIG. 19 illustrates a graph of the relationship between the operation position of the operation rod 3 and the force correction value, in which the horizontal axis represents the operation position in the corresponding direction of degree of freedom (Y-axis direction) of the operation rod 3, and the vertical axis represents the force correction value. In addition, each of the plurality of graphs illustrated in FIG. 19 corresponds to the operation position in one length direction of the operation rod 3.

It should be noted that the force correction value is a value representing an influence of the gravity of the operation rod 3 to the force in a predetermined operation position of the operation rod 3. In this way, the force correction unit 3115*a*-7 can calculate the corrected force component value by a simpler calculation.

In addition, in this embodiment, the relationship between the operation position of the operation rod 3 and the force correction value illustrated in FIG. 19 is stored as a correction table as illustrated in FIG. 20. FIG. 20 is a diagram illustrating a data structure of the correction table. As illustrated in FIG. 20, the correction table stores force correction values W11, W12, . . . at predetermined operation positions of the operation rod 3 in association with the operation positions of the operation rod 3 (the operation positions $L_1$, $L_2$, . . . $L_m$ in the length direction and the operation positions $y_1$, $y_2$, . . . $y_j$ in the Y-axis direction, in the example illustrated in FIG. 20). The correction table as illustrated in FIG. 20 is stored in the storage device of the control unit 11 or the like, for example.

The force correction unit 3115*a*-7 calculates the corrected force component value using the correction table illustrated in FIG. 20 as follows, for example.

First, the force correction unit 3115*a*-7 obtains an operation position L in the length direction of the operation rod 3. Then, it is determined that the obtained operation position L in the length direction corresponds to which one of the operation positions in the length direction stored in the correction table. For example, it is supposed that the obtained operation position L in the length direction corresponds to $L_i$ in the length direction in the correction table.

Next, the force correction unit 3115*a*-7 determines where the operation position y in the corresponding direction of degree of freedom (Y-axis direction) of the obtained position information of the operation rod 3 exists between the operation positions ($y_1$, $y_2$, . . . $y_j$) in the Y-axis direction stored in the correction table. For example, it is supposed that the operation position y exists between the operation positions $y_k$ and $y_{k+1}$ in the Y-axis direction in the correction table.

Here, if the operation position $y_k$ has a value smaller than the current operation position y, the operation position $y_k$ is set as the first operation position. On the other hand, the operation position $y_{k+1}$ having a value larger than the current operation position y is set as the second operation position.

After that, the force correction unit 3115*a*-7 sets the first force correction value, which is a force correction value Wik when the operation position in the length direction is $L_i$ and the operation position in the Y-axis direction is the first operation position $y_k$ in the correction table. On the other hand, it sets the second force correction value, which is a force correction value Wi(k+1) when the operation position in the Y-axis direction is the second operation position $y_{k+1}$.

Further, after that, the force correction unit 3115*a*-7 calculates the force correction value at the operation position y in the Y-axis direction and the operation position L in the length direction, by linear interpolation using the first force correction value Wik and the second force correction value Wi(k+1).

Note that if the current values of the operation positions in the length direction and in the Y-axis direction are identical to the values of the operation positions in the length direction and in the Y-axis direction stored in the correction table, the force correction value associated to the current values of the operation positions in the length direction and in the Y-axis direction can be set as the current force correction value, without using the linear interpolation described above.

After calculating the force correction value, the force correction unit 3115*a*-7 calculates the force component value from the obtained signal value of the force component signal, for example, and subtracts (adds) the force correction value from (to) the calculated force component value, so that the corrected force component value (in the Y-axis direction) can be calculated.

It should be noted that, in the above description, if the correction table does not store the operation position in the length direction corresponding to the operation position L in the length direction, the force correction unit 3115*a*-7 may determine a range including the operation position L in the length direction so as to perform the linear interpolation described above.

For example, if it is determined that the operation position L in the length direction exists between the operation positions $L_i$ and $L_{i+1}$ in the length direction in the correction table, the first operation position is set to coordinates ($L_i$, $y_k$), the second operation position is set to coordinates ($L_{i+1}$, $y_{k+1}$), the first force correction value is set to Wik, and the second force correction value is set to W(i+1)(k+1), so as to perform the linear interpolation described above. Thus, the force correction value at the operation position L in the length direction and the operation position y in the Y-axis direction can be calculated.

After the force correction unit 3115*a*-7 calculates the corrected force component value, the force correction unit 3115*a*-7 outputs the corrected force component value to the corresponding first command calculation unit 3115*a*-1 (Step S3004).

After outputting the corrected force component value, the first command calculation unit 3115*a*-1 calculates the first motor control command based on the received corrected force component value (Step S3005). Specifically, for example, the first motor control command can be calculated by using an equation or the like representing that the first motor control command linearly increases with respect to the corrected force component value.

It should be noted that the operations of the training device 300 in Steps S3006 and S3007 after calculating the first motor control command respectively correspond to the operations of the training device 100 in Steps S23 and S24, for executing the first operation mode described above with reference to FIG. 8B, as the description of the training device 100 according to the first embodiment. Therefore, the descriptions of the operations in Steps S3006 and S3007 are omitted.

In this way, the force correction unit 3115*a*-7 calculates the corrected force component value based on the predetermined relationship between the operation position of the operation rod and the force correction value as illustrated in FIGS. 19 and 20. Thus, the corrected force component value can be calculated by a simpler calculation.

In addition, the relationship between the operation position of the operation rod and the force correction value as illustrated in FIG. 19 is expressed by the correction table as illustrated in FIG. 20. Thus, the corrected force component value can be calculated more easily by using the stored data.

Further, as described above, in the case where the operation position of the operation rod 3 exists between a plurality of operation positions stored in the correction table, the force correction unit 3115*a*-7 calculates the force correction amount by the linear interpolation using the first force correction value and the second force correction value. Thus, even if the current operation position of the operation rod 3 is an operation position that is not stored in the correction table, the force correction value at the current operation position of the operation rod 3 can be calculated.

In addition, since the first motor control command is calculated based on the corrected force component value, it is possible to suppress an unintended operation of the operation rod 3 depending on an operation position of the operation rod 3 when executing the first operation mode.

(8) Effects of the Embodiments

The effects of the third embodiment are as follows.

The training device of the third embodiment (for example, the training device 300) is the training device for training user's upper and/or lower limb in accordance with a predetermined operation mode.

The training device of the third embodiment (for example, the training device 300) includes an operation rod (for example, the operation rod 3), a motor (for example, the Y-axis direction tilt motor 135*a*, the X-axis direction tilt motor 135*b*, and the telescoping motor 359), a force detection unit (for example, the Y-axis direction force detection unit 175, the X-axis direction force detection unit 177, the expansion detection unit 393), a rotation information output sensor (for example, the first rotation information output sensor 135*a*-1, the second rotation information output sensor 135*b*-1, the third rotation information output sensor 359-1), a first command calculation unit (for example, the first command calculation units 3115*a*-1, 3115*b*-1, 3115*c*-1), and a force correction unit (for example, 3115*a*-7, 3115*b*-7, and 3115*c*-7).

The operation rod is movably supported by a fixed frame (for example, the fixed frame 1). Therefore, the training device can move a limb held by the operation rod. The fixed frame is placed on a floor surface or close to a floor surface. The motor drives to operate the operation rod in the direction of degree of freedom in which the operation rod can move, on the basis of a motor control command. The force detection unit detects a force component. Then, the force detection unit outputs a force component signal based on a magnitude of the detected force component. The force component is a component of force applied to the operation rod, in the direction of degree of freedom in which the operation rod can move.

The rotation information output sensor detects an operation position of the operation rod based on a rotation amount of the motor. The operation position of the operation rod is a position in the direction of degree of freedom in which the operation rod can move.

The force correction unit calculates a corrected force component value based on the operation position of the operation rod and the force component signal. The first command calculation unit calculates a first motor control command as the motor control command based on the corrected force component value. The first motor control command is a motor control command for controlling a corresponding motor.

In the training device of the third embodiment, when executing an operation mode (first operation mode) in which the operation rod is operated based on a force applied to the operation rod, the force correction unit calculates the corrected force component value based on the operation position of the operation rod and the force component signal. Then, the first command calculation unit calculates the first motor control command based on the corrected force component value.

In this way, in the training device of the third embodiment, when executing the first operation mode in which the operation rod is operated based on a force applied to the operation rod, an unintended operation of the operation rod depending on the operation position of the operation rod can be suppressed. It is because the force correction unit calculates the corrected force component value based on the operation position of the operation rod and the force component signal, and the first command calculation unit can calculate the first motor control command based on the corrected force component value. It should be noted that the corrected force component value can be used as the force sense trigger in the second operation mode.

In the training device of the third embodiment, the force correction unit calculates the corrected force component value based on a relationship between the operation position of the operation rod and the force correction value. The force correction value is a correction value determined based on the operation position. In this way, the corrected force component value can be calculated by a simpler calculation.

In the training device of the third embodiment, the relationship described above is expressed by a correction table. The correction table stores the operation position and the force correction value corresponding to the operation position in association with each other. In this way, the force component signal can be corrected more easily using the stored data.

In the training device of the third embodiment, the force correction value at a current operation position of the operation rod is calculated by linear interpolation using the first force correction value and the second force correction value. The first force correction value is a force correction value associated with a first operation position. The first operation position is an operation position on the correction table, which is smaller than the current operation position of the operation rod. The second force correction value is a force correction value associated with a second operation position. The second operation position is an operation position on the correction table, which is larger than the current operation position of the operation rod.

In this way, the force correction value at an arbitrary operation position of the operation rod can be calculated.

In the training device of the third embodiment, the operation position of the operation rod is calculated by linear interpolation associated with at least two operation positions except the operation position in the direction of degree of freedom in which the operation rod can move. In this way, the operation position of the operation rod can be calculated more easily.

(9) Other Embodiments

Although the embodiments of the present invention are described above, the present invention is not limited to the embodiments described above but can be variously modified within the scope of the invention without deviating from the spirit thereof. In particular, the plurality of embodiments and variations described in this specification can be arbitrarily combined as necessary.

(A) Other Embodiments of Training Device

Although the training device 100 according to the first embodiment, the training device 200 according to the second embodiment, and the training device 300 according to the third embodiment are separately described above, this is not a limitation. All the first to third embodiments described above may be combined to constitute the training device. In other words, the training device may have all characteristics described in the first embodiment to the third embodiment.

Alternatively, any two of the characteristics of the training device 100 according to the first embodiment, the characteristics of the training device 200 according to the second embodiment, and the characteristics of the training device 300 according to the third embodiment may be combined to constitute the training device.

(B) Other Embodiments of Method for Calculating Force Correction Value

In the third embodiment described above, the force correction unit 3115*a*-7 calculates the force correction value using the correction table. However, this is not a limitation. As described below, the force correction unit 3115*a*-7 may calculate the force correction value without using the correction table. In other words, the force correction unit 3115*a*-7 may correct the force component signal based on the operation position (tilt angle, expansion and contraction length) of the operation rod 3 and the weight of the operation rod 3 without using the correction table.

In calculation of the force component value, the length of the operation rod 3 is also taken into account for the correction. For example, comparing the case where the operation rod 3 is expanded with the case where the operation rod 3 is contracted, when applying the same force to the limb support member 31, the force component signal detected by the force detection unit becomes larger in the case where the operation rod 3 is expanded than in the case where the same is contracted. Since the calibration data is generated in the state of an intermediate length (Lc), a force component signal value F' after the correction by taking the length of the operation rod into account is expressed by $F \times Lc/L$, where L is the length of the operation rod, and F is the force component value based on the force component signal.

When correcting the influence of the gravity component, it is an object to eliminate an influence of the weight of the operation rod 3.

First, it is calculated the product GF of the weight of the entire operation rod 3 including the cover 353 and the limb support member 31 and a distance Lg between the position of center-of-gravity and the pivot position.

Next, when the tilt angle of the operation rod 3 from the vertical direction is represented by φ, the force correction value of the operation rod 3 in the X-axis direction and in the Y-axis direction can be calculated from the expression (GF*sin φ)/Lg. In addition, the force correction value in the length direction can be calculated as –G*cos φ, where G is the sum of the weight of the cover 353 and the weight of the limb support member 31.

Further, the force correction unit 3115*a*-7 can calculate the corrected force component value by subtracting (adding) the force correction value calculated as described above from (to) the force component value calculated from the force component signal, for example, without using the correction table.

INDUSTRIAL APPLICABILITY

The present invention can be widely applied to training devices having an operation rod driven by motors so as to aid rehabilitation of an upper limb and a lower limb of a patient according to a predetermined training program.

REFERENCE SIGNS LIST

100, 200, 300 training device
1 fixed frame
11 control unit
111 command generation unit
1111 operation command unit
1113 transmission switching unit
1115*a*, 1115*b*, 1115*c* motor control command unit
1115*a*-1, 1115*b*-1, 1115*c*-1 first command calculation unit
1115*a*-3, 1115*b*-3, 1115*c*-3 second command calculation unit
1115*a*-5, 1115*b*-5, 1115*c*-5 control command switching unit
2115*a*, 2115*b*, 2115*c* motor control command unit
2115*a*-1, 2115*b*-1, 2115*c*-1 first command calculation unit
2115*a*-3, 2115*b*-3, 2115*c*-3 second command calculation unit
2115*a*-5, 2115*b*-5, 2115*c*-5 control command switching unit
2115*a*-7, 2115*b*-7, 2115*c*-7 force component signal correction unit
2115*a*-71, 2115*b*-71, 2115*c*-71 drift correction unit
2115*a*-73, 2115*b*-73, 2115*c*-73 calibration data storage unit
3115*a*, 3115*b*, 3115*c* motor control command unit
3115*a*-1, 3115*b*-1, 3115*c*-1 first command calculation unit
3115*a*-3, 3115*b*-3, 3115*c*-3 second command calculation unit
3115*a*-5, 3115*b*-5, 3115*c*-5 control command switching unit
3115*a*-7, 3115*b*-7, 3115*c*-7 force correction unit
113*a*, 113*b*, 113*c* motor control unit
13 operation rod tilt mechanism
131 X-axis direction tilt member
131-1 biasing member fixing portion
131*a*, 131*b* shaft
133 Y-axis direction tilt member
133*a*, 133*b* shaft
135*a* motor (Y-axis direction tilt motor)
135*a*-1 first rotation information output sensor
135*b* motor (X-axis direction tilt motor)
135*b*-1 second rotation information output sensor
15*a*, 15*b* operation rod tilt mechanism fixing member
17 force detection mechanism
171 Y-axis direction force detection member
171*a*, 171*b* shaft
173 X-axis direction force detection member
173-1 biasing member fixing portion
173*a*, 173*b* shaft
175 force detection unit (Y-axis direction force detection unit)
177 force detection unit (X-axis direction force detection unit)
179 biasing member
3 operation rod
31 limb support member
33 fixed stay
35 telescoping mechanism
351 movable stay
353 cover
355 nut
357 threaded shaft
359 motor (telescoping motor)
359-1 third rotation information output sensor
37 guide rail
39 length direction force detection unit
391 biasing member
393 expansion detection unit
5 training instruction unit
7 fixing member
9 chair
91 chair connecting member
a input
b, c, d output
e, f input
g output

The invention claimed is:

1. A training device for training user's upper and/or lower limb in accordance with a predetermined operation mode, the device comprising:

an operation rod movably supported by a fixed frame and configured to tilt and move in a length direction of the operation rod to move a limb, the fixed frame being placed on or in the vicinity of a floor surface;

a motor configured to drive the operation rod to operate in a direction of degree of freedom in which the operation rod can move, on the basis of a motor control command;

a force detection unit configured to 1) detect a force component of the force applied to the operation rod in the direction of degree of freedom in which the operation rod can move and 2) output a force component signal based on a magnitude of the detected force component;

a rotation information output sensor configured to detect an operation position of the operation rod in the direction of degree of freedom in which the operation rod can move based on a rotation amount of the motor, the operation position including a position in the length direction;

a force correction unit configured to calculate a corrected force component value based on the operation position of the operation rod and the force component signal; and a first command calculation unit configured to calculate a first motor control command that controls the motor as the motor control command based on the corrected force component value, wherein the force correction unit is configured to calculate the corrected force component value based on a relationship between the operation position of the operation rod and a force correction value determined based on the operation position, and the relationship is expressed as a correction table storing the operation position and the force correction value corresponding to the operation position in association with each other.

2. The training device according to claim 1, wherein the force correction value at a current operation position of the operation rod is configured to be calculated by linear interpolation, using a first force correction value associated with a first operation position having a smaller value than the current operation position on the correction table and a second force correction value associated with a second operation position having a larger value than the current operation position on the correction table.

3. The training device according to claim 1, wherein the operation position of the operation rod is configured to be calculated by linear interpolation associated with at least two operation positions except the operation position in the direction of degree of freedom in which the operation rod can move.

4. The training device according to claim 1, wherein the force correction unit is configured to calculate the corrected force component value based on the operation position of the operation rod and a weight of the operation rod.

5. The training device according to claim 1, further comprising an operation command unit configured to generate calibration data in a state where a length of the operation rod is an intermediate length, the calibration data representing a variation amount of a force applied to the operation rod with respect to a variation of a signal value of the force component signal, and wherein the force correction unit is configured to calculate the corrected force component value based on the force component signal, the intermediate length of the operation rod, and a length of the operation rod during operation.

6. A method of correcting a force in a training device including an operation rod configured to tilt and move in a length direction of the operation rod to move user's upper and/or lower limb, a force detection unit configured to detect a force component of a force applied to the operation rod in a direction of degree of freedom in which the operation rod can move and to output a force component signal based on a magnitude of the detected force component, and a rotation information output sensor configured to detect an operation position of the operation rod in a corresponding direction of degree of freedom in which the operation rod can move, the method comprising:

obtaining the force component signal from the force detection unit;

obtaining the operation position of the operation rod from the rotation information output sensor, the operation position including a position in the length direction;

calculating a force correction value based on the operation position of the operation rod; and calculating a corrected force component value that is a corrected value of the force applied to the operation rod, by applying the force correction value to a force component value calculated from the force component signal, wherein the corrected force component value is calculated based on a relationship between the operation position of the operation rod and a force correction value determined based on the operation position, and the relationship is expressed as a correction table storing the operation position and the force correction value corresponding to the operation position in association with each other.

* * * * *